US005795208A

United States Patent [19]

Hattori

[11] Patent Number: 5,795,208

[45] **Date of Patent: *Aug. 18, 1998**

[54] MANUFACTURE OF ELECTRON EMITTER BY REPLICA TECHNIQUE

[75] Inventor: Atsuo Hattori, Hamamatsu, Japan

[73] Assignee: Yamaha Corporation, Shizuoka, Japan

[ * ] Notice: The term of this patent shall not extend beyond the expiration date of Pat. No. 5,720,641.

[21] Appl. No.: 540,418

[22] Filed: Oct. 6, 1995

[30] Foreign Application Priority Data

| | | | |
|---|---|---|---|
| Oct. 11, 1994 | [JP] | Japan | 6-271754 |
| Oct. 11, 1994 | [JP] | Japan | 6-271755 |
| Oct. 11, 1994 | [JP] | Japan | 6-271756 |

[51] Int. Cl.[6] ..... H01J 9/02; H01J 1/30

[52] U.S. Cl. ..... 445/50; 445/24

[58] Field of Search ..... 445/24, 50

[56] References Cited

U.S. PATENT DOCUMENTS

| | | | |
|---|---|---|---|
| 5,100,355 | 3/1992 | Marcus et al. | 445/24 |
| 5,141,459 | 8/1992 | Zimmerman . | |
| 5,203,731 | 4/1993 | Zimmerman . | |
| 5,219,792 | 6/1993 | Kim et al. . | |
| 5,285,017 | 2/1994 | Gardner . | |
| 5,334,908 | 8/1994 | Zimmerman . | |
| 5,358,909 | 10/1994 | Hashiguchi et al. | 437/228 |
| 5,371,041 | 12/1994 | Liou et al. . | |
| 5,403,757 | 4/1995 | Suzuki . | |
| 5,408,130 | 4/1995 | Woo et al. . | |
| 5,414,302 | 5/1995 | Shin et al. . | |
| 5,472,912 | 12/1995 | Miller | 437/194 |

FOREIGN PATENT DOCUMENTS

| | | |
|---|---|---|
| 0639847 | 8/1994 | European Pat. Off. . |
| 4310604 | 3/1993 | Germany . |
| 4-61729 | 2/1992 | Japan . |
| 5-174703 | 7/1993 | Japan . |
| 5-225895 | 9/1993 | Japan . |
| 91/10252 | 7/1991 | WIPO . |
| 92/02030 | 2/1992 | WIPO . |
| 92/02031 | 2/1992 | WIPO . |

OTHER PUBLICATIONS

Busta, H., "Review: Vacuum microelectronics—1992", *J. Micromech. Microeng.* 2 (1992), pp. 47–74.

Itoh, J., "Recent progress in vacuum microelectronics", *Applied Physics* vol. 62, No. 12, (1993) pp. 1216–1220.

Akamine, et al., "Low temperature thermal oxidation sharpening of microcase tips", *Journal of Vacuum Sci. & Tech.* 10(5), (1992), pp. 2307–2310.

S.M. Zimmerman, et al., "Development Progress Toward the Fabrication of Vacuum Microelectronic Devices Using Conventional Semiconductor Processing", IEDM 90, pp. 163–166.

S.M. Zimmerman, et al., "A Fabrication Method for the Integration of Vacuum Microelectronic Devices", IEEE Transactions on Electron Devices, vol. 38, No. 10, Oct. 1991, pp. 2294–2303.

*Primary Examiner*—P. Austin Bradley
*Assistant Examiner*—Jeffrey T. Knapp
*Attorney, Agent, or Firm*—Ostrolenk, Faber, Gerb & Soffen, LLP

[57] ABSTRACT

A method of manufacturing a microelectronic device includes the steps of: (a) providing a hole in a substrate; (b) forming a first sacrificial film having a slanted side surface on a side wall of the hole; (c) applying a second sacrificial film on the first sacrificial film to fill the hole and form a cusp; (d) forming an electron emitting material layer capable of emitting electrons therefrom under an electric field on the second sacrificial film to fill the cusp to form a tip; and (e) removing the first and second sacrificial films to expose the tip. This method enables to manufacture an electric field emission type device having an emitter tip with a small radius of curvature and small apex angle.

21 Claims, 44 Drawing Sheets

MANUFACTURE OF ELECTRON EMITTER BY REPLICA TECHNIQUE

BACKGROUND OF THE INVENTION a) Field of the Invention

The present invention relates to a method of manufacturing an electric field emission (electron emission by electric field) type device.

b) Description of the Related Art

A vacuum microelectronic device technique has recently become remarkable. This technique utilizes a fine processing technique of semiconductor integrated circuits to form a minute cold cathode electron source which is used for ultra fine amplifier devices, integrated circuits, flat display units, and the like. To realize practically usable vacuum microelectronic devices, it is essential to develop a cold cathode electron source capable of reliably flowing a large current upon application of a low voltage. The cold cathode electron source is mainly classified into an electric field emission type that electrons are emitted from a sharp tip of an emitter electrode by a concentrated electric field, and another type that high energy electrons are generated in semiconductor by means of avalanche effects or the like and emitted to the outside of the semiconductor. The emitter electrode is classified into a vertical emitter having a sharp needle tip formed on a substrate in the vertical direction and a lateral emitter having a sharp needle tip formed on a substrate along the substrate surface.

A method of manufacturing a field emission type electron source of a lateral emitter type has been proposed (refer to S. Zimmerman, Abs. 3rd Int. Vacuum Microelectronics Conf., Monterey, 1990, 1–4). With this method, a recess 102 having a vertical side wall is formed in a substrate 101 as shown in FIG. 43A, a sacrificial layer 103 is deposited by directionless (isotropic) conformal deposition and thereafter an electron emitting material layer 104 is deposited as shown in FIG. 43B, and finally an emitter 104*a* is formed by removing the substrate 101 and sacrificial layer 103 as shown in FIG. 43C.

Conformal deposition forms a film having the same thickness both on the horizontal and vertical surfaces. There is formed a curved (rounded) surface at an edge. The recess is completely filled with the film when the thickness of the film on the vertical surface of the recess exceeds a half of the width of the recess. A cusp of an inverted cone shape is formed on the surface of the film above the recess. The depth of the cusp is less than the thickness of the recess.

With the above method, in order to obtain an emitter mold with a cusp of an inverted cone shape having a desired depth, it is necessary to deposit the sacrificial film thicker than the desired depth of the cusp. However, if a thick sacrificial layer is deposited by a single process, cracks may be formed by thermal stress generated when the layer is cooled after the deposition. If the electron emitting material enters the cracks, an emitter having a desired shape cannot be obtained so that an electric field emission type device having a desired performance cannot be obtained.

With this method illustrated in FIGS. 43A to 43C, the sacrificial layer is formed by deposition conformal to the surface of the recess with a vertical side wall, i.e., deposition having good step coverage. With this conformal deposition, as shown in FIG. 44A the radius of curvature of the cusp A formed on the sacrificial film 103 is likely to become large in the order of 50 nm, and it is difficult to form an emitter having a sharp tip.

If deposition having poor step coverage is used, the thickness of the film on the vertical surface is less than that on the horizontal surface. Even if a sacrificial film having the same thickness as that shown in FIG. 44A, the recess is not completely filled with the film and overhangs 105 are formed as shown in FIG. 44B. It is therefore impossible to form an emitter mold having a cusp of an inverted cone shape. Even with this method, if the sacrificial film 103 is made thicker, the overhangs contact together and it is possible to form an emitter mold having a cusp of an inverted cone shape as shown in FIG. 44C. However, in this case, it is difficult to obtain a small apex angle of the cusp. Furthermore, the sacrificial film is made thicker than the depth of the emitter mold so that cracks may be more likely to be formed.

Another method of manufacturing a vertical type emitter has been proposed as disclosed, for example, in Japanese Patent Laid-open Publications Nos. 4-61729 and 5-225895. With this method, on a substrate 106 having a predetermined crystallographic plane such as (1 0 0), an etching mask 107 is formed as shown in FIG. 45A. The substrate 106 is anisotropically etched to form a pyramid recess 108 having side surfaces of the (1 1 1) plane or the like as shown in FIG. 45B. An electron emitting material layer 109 is deposited as shown in FIG. 45C, and an emitter 109*a* is produced by removing unnecessary regions as shown in FIG. 45D.

With this method, the recess is pyramid-shaped and its apex angle is determined by the angle of the crystallographic planes of the substrate. If the recess formed by anisotropic etching is used for forming an emitter mold, it is difficult to obtain an emitter having a tip of a small apex angle. The emitter tip of a pyramid shape does not show stable current emission characteristics. Substrates capable of being anisotropically etched are only single crystal silicon, GaAs, and the like having the (1 0 0) plane, and the etching is practically limited to wet etching. The degree of design freedom is small and fine processing of the device is difficult.

Another method using anisotropic etching has been proposed as disclosed in Japanese Patent Laid-open Publication No. 5-174703. As shown in FIG. 46A, this method uses a structure that a silicon substrate 106 and a silicon layer 111 are laminated with a silicon oxide film 110 being interposed therebetween. An etching mask 112 is formed on the silicon layer 111, and anisotropic etching is performed using the oxide film 110 as an etching stopper. Thereafter, the etching mask 112 is removed and as shown in FIG. 46B an oxide film 113 is formed by thermal oxidation. The oxide film 113 forms on its surface a cusp having a small apex angle because of its volume expansion. An electron emitting material layer 114 is deposited on the oxide film 113.

With this method, the cusp is formed by thermal oxidation and used for forming an emitter mold. Although the apex angle of the cusp can be made small, it is difficult to obtain a cusp having a small apex angle before the heat treatment. Substrates to be used are limited, the degree of design freedom is small, and fine processing of the device is difficult.

SUMMARY OF THE INVENTION

An object of the present invention is to provide an electron emitter having a good emission efficiency.

Another object of this invention is to provide a method of manufacturing an electric field emission type device capable of forming an emitter with a tip having a small radius of curvature and a small apex angle.

According to one aspect of the present invention, there is provided a method of manufacturing a microelectronic device comprising the steps of:

(a) providing a hole in a substrate;

(b) forming a first sacrificial film having a side surface on a side wall of the hole with a first material;

(c) filling the hole with a second sacrificial film on the first sacrificial film to form a cusp;

(d) forming an electron emitting material layer capable of emitting electrons therefrom under an electric field on the second sacrificial film to fill the cusp to form a tip; and (e) removing the first sacrificial film and the second sacrificial layer to expose the tip.

DETAILED DESCRIPTION OF THE PREFERRED EMBODIMENTS

Embodiments of the present invention will be described with reference to the accompanying drawings.

Figure 1A:
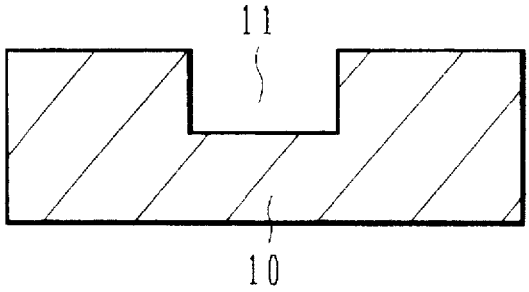
FIGS. 1A to 1F are cross sectional views for illustrating processes of manufacturing an emitter according to an embodiment of the invention.

FIGS. 1A to 1F illustrate processes of manufacturing an electron emitting material layer according to a basic embodiment of the invention. As shown in FIG. 1A, at least one recess 11 having a vertical side wall is formed in the surface of a substrate 10. In FIG. 1A, one recess is for one emitter is shown. If a field emitter array (FEA) having a number of emitters is to be formed, a number of recesses are formed in a surface of the substrate. If a point type emitter is to be formed, the cross section of the recess 11 in a plane parallel to the substrate surface is circular as shown at 11*a* in FIG. 2A, and if a wedge type emitter is to be formed, the cross section is stripe-shaped as shown at 11*b* in FIG. 2B.

In this embodiment, the substrate 10 is a silicon substrate, and the recess 11 is formed by using a resist mask formed by ordinary lithography and reactive ion etching (RIE). The size of the recess 11 is determined by the size of a cold cathode emitter to be formed. For example, the width is in the order of 0.1 to 1 μm, and the depth is about a half of the width. As the substrate 10, semiconductor substrates made of Ge, GaAs, or the like, insulating material substrates made of glass, quartz, or the like, conductive material substrates made of Al, Cu, or the like may also be used. A laminate of these substrates may also be used. In forming the recess 11, ion milling may be used. Without using a resist mask, the recess 11 may be directly formed in the substrate 10 by ion milling or by using a laser beam.

Figure 1B:
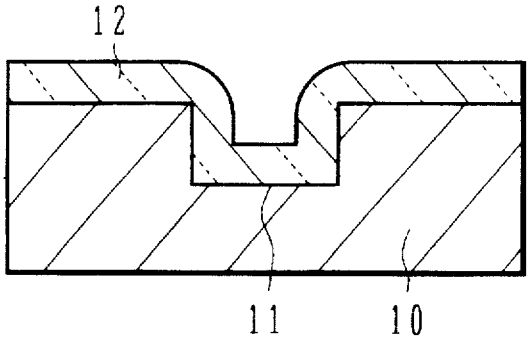

Next, as shown in FIG. 1B, a first sacrificial film 12 of silicon oxide is deposited on the substrate 10 formed with the recess 11. As a film deposition method, low pressure CVD having good step coverage is used. The surface of the first sacrificial film 12 is conformal to the topology of the underlying recess 11. The proper thickness of the first sacrificial film 12 is determined by the size of the recess 11. In this embodiment, the thickness is set to about 0.05 to 0.5 μm, for example.

As the first sacrificial film 12, other films may also be used in place of the silicon oxide film, for example, insulating material films such as a silicon nitride film, semiconductor films such as an amorphous silicon film and a polysilicon film, and conductive material films such as Ti, Mo, Al, TiN, TiW, and WSi. In place of low pressure CVD, other film deposition methods having good step coverage may also be used, for example, optical CVD, and CVD using $O_3$ and TEOS.

Figure 1C:
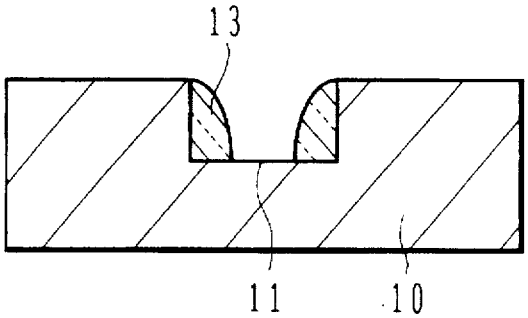

Next, the first sacrificial film 12 is etched back to leave a side spacer 13 on the side wall of the recess 11 as shown in FIG. 1C. As this etch-back, anisotropic dry etching is used. For example, it may be low pressure magnetron reactive ion etching (RIE), microwave plasma etching, electron cyclotron resonance (ECR) plasma etching, optical excitation etching, inductive excitation plasma etching, or the like. This side spacer 13 forms a gradually declining smooth slope on the side wall, and the volume of the recess is reduced.

Figure 1D:
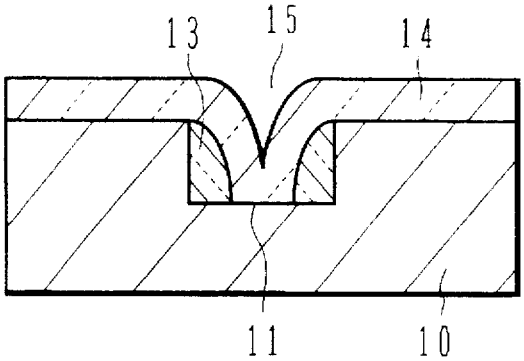

Next, as shown in FIG. 1D, a second sacrificial film 14 of silicon oxide, which is same as the first sacrificial film 12, is deposited over the whole surface of the substrate, by a film deposition method having good step coverage. A film deposition method having good step coverage may be considered as a method of depositing a conformal film. Instead of silicon oxide, the second sacrificial film may also be made of insulating material such as silicon nitride and aluminum oxide, or conductive material similar to those described for the first sacrificial film 14. The thickness of the second sacrificial film 14 is selected to close the bottom space in the recess from the side wall, e.g. in the order of 50 to 500 nm. The second sacrificial film 14 becomes an underlying mold for molding an emitter. The upper surface of the second sacrificial film 14 formed on the recess smoothly converges downward because the tapered side spacer is formed on the side wall of the recess. It is possible to form a cusp having a sharper apex portion and a smoother surface over a broader range of the film thickness, than a conventional cusp. The cusp 15 having a sharp apex portion can be formed on the surface of the second sacrificial film 14 as shown in FIG. 1D without making the film 14 so thick as conventional. Because of the side spacer 13, the upper opening of the recess 11 is substantially divergently tapered in the upward direction. From another point of view, the diameter of the recess 11 is gradually narrowed in the downward direction. Therefore, the second sacrificial film 14 can be formed relatively thin by a film deposition method having good step coverage, and generation of cracks is avoided.

Figure 1E:
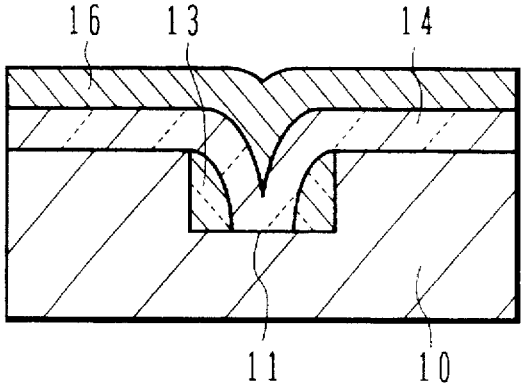

Next, as shown in FIG. 1E, an electron emitting material layer (cold cathode material layer) 16 of TiN is formed on the second sacrificial film 14.

As the material of the electron emitting material layer 16, other conductive materials may also be used such as metals (W, Al, Cu, Mo, Au, Pt, Ag, Ti, Ni, Ta, Re, Cr, Zr, Hf, Y, Bi, Sr, Tl, Pb, Ca, Sn, Ge, and etc.) and compounds thereof, semiconductor material (Si, Ge, GaAs, InSb, InAs, InSe, etc.), silicide materials ($WSi_2$, $MoSi_2$, $TiSi_2$, $TaSi_2$, NiSi, $CoSi_2$, etc.) and dielectric materials (diamond, diamond-like-carbon (DLC), $BaTiO_3$, $LiNbO_3$, etc.). The second sacrificial film 14 is etched at a later process. It is therefore necessary to have a sufficient etching selection ratio of the second sacrificial film 14 to the electron emitting material layer 16 by selecting a proper combination of both materials.

Figure 1F:
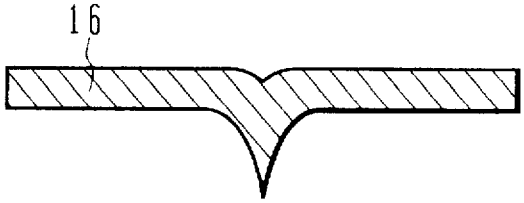

Lastly, unnecessary regions under the emitter are removed by wet etching or dry etching. For example, as shown in FIG. 1F, all the substrate 10, side spacer 13, and second sacrificial film 14 are removed to leave the emitter having a sharp tip. In this embodiment, a fine emitter can be obtained which has a tip with a radius of curvature of about 10 nm or smaller.

Figure 2A:
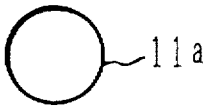
FIGS. 2A to 2E are plan views for illustrating plan shapes of the recess, and cross sectional views for illustrating some points to be considered when a side spacer is formed.
Figure 2B:
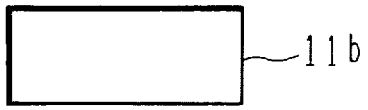
Figure 2C:
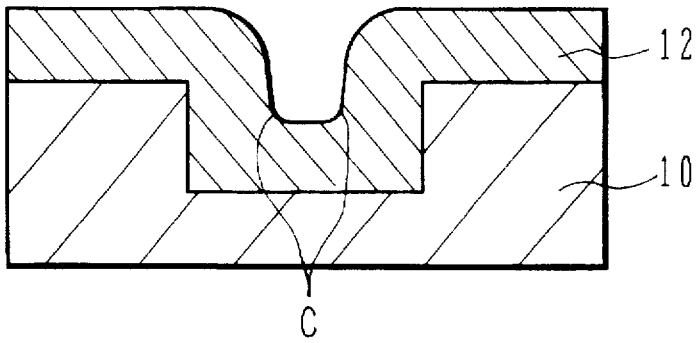
Figure 2D:
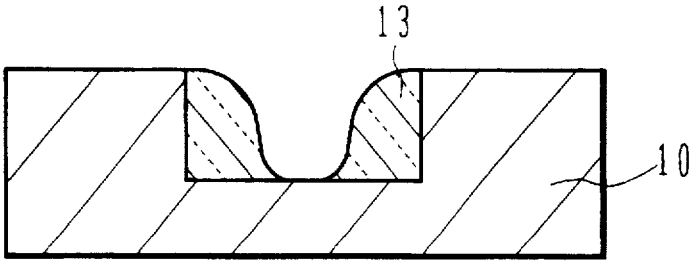
Figure 2E:
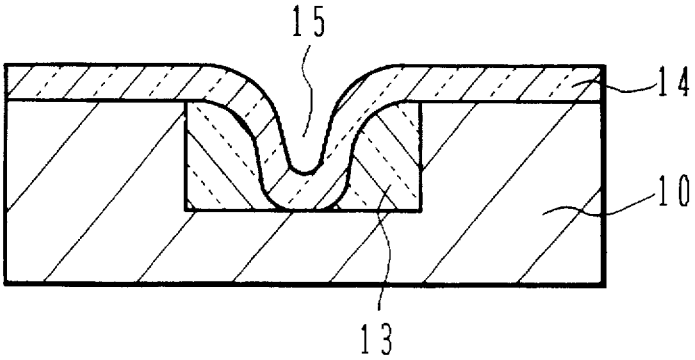

In this embodiment, the first sacrificial film 12 is formed by a film deposition method having good step coverage. FIG. 2C is an enlarged view of FIG. 1B. With this film deposition method, the bottom corner C of the cusp is likely to be rounded to have a large radius of curvature as shown in FIG. 2C. As the first sacrificial film 11 is etched back in this state, the side spacer 13 is formed with a skirt portion as shown in FIG. 2D. This shape of the side spacer 13 affects the shape of the second sacrificial film 14 deposited thereon so that as shown in FIG. 2E, a radius of curvature of the cusp 15 of the second sacrificial film 14 or emitter mold is possibly made as large as 50 nm or more.

Figure 3A:
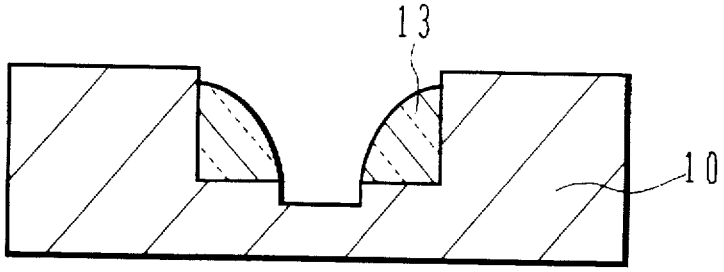
FIGS. 3A and 3B are cross sectional views for illustrating processes of forming a sacrificial film according to another embodiment of the invention.
Figure 3B:
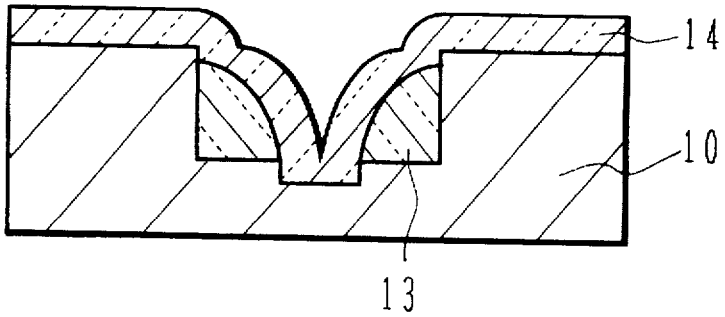

In order to reduce this problem, the first sacrificial film etch-back process for forming the side spacer is preferably controlled to be an over-etch process so that the substrate is also slightly etched. The shape of the side spacer 13 formed by this process is shown in FIG. 3A. This process forms the side spacer 13 of a good shape without a skirt even if the corner C has a large radius of curvature as shown in FIG. 2A. As the second sacrificial film 14 is deposited thereafter, the mold for molding an emitter with a sharp tip and a radius of curvature of 10 nm or smaller can be obtained as shown in FIG. 3B.

Figure 4:
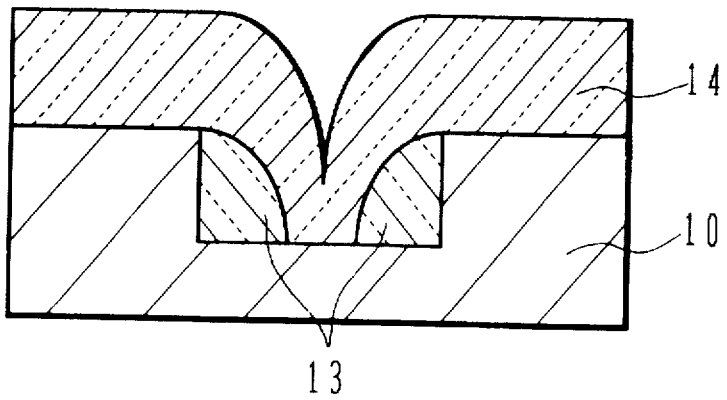
FIG. 4 is a cross sectional view for illustrating processes of forming a sacrificial film according to still another embodiment of the invention.

In the above embodiment, the second sacrificial film 14 may be formed by a film deposition method having poor step coverage, for example, by sputtering. Deposition with poor step coverage is a directional deposition to some extent. The structure obtained by such a film deposition method is shown in FIG. 4. The film thickness on the top flat surface is larger than that in the recess. Compared to the sacrificial films of FIGS. 2D and 2E which are formed by a film deposition method having good step coverage, an emitter mold having a cusp with a smaller radius of curvature can be obtained.

Figure 5A:
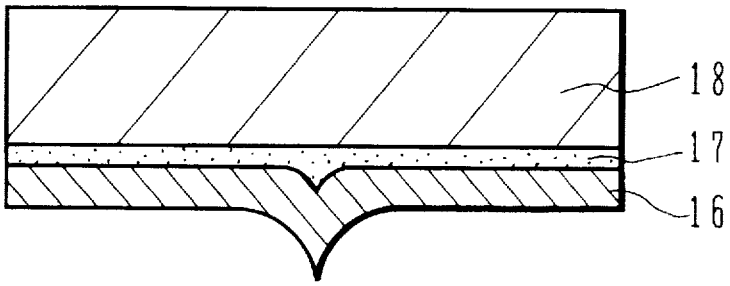
FIGS. 5A and 5B are cross sectional views of emitter support structures according to another embodiment.
Figure 5B:
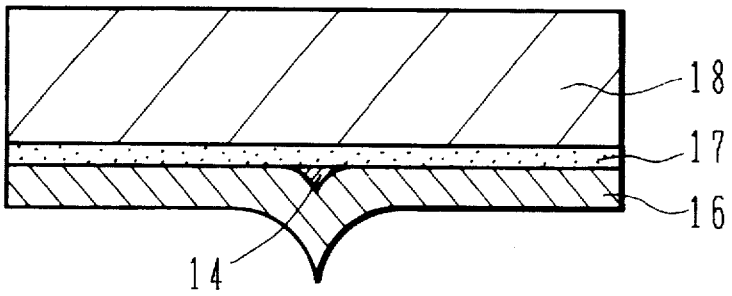

In the embodiment shown in FIGS. 1A to 1F, a sole electron emitter layer 16 is provided. In order to give the electron emitting material layer 16 a sufficient mechanical strength, it is preferable to bond a support substrate 18 to the electron emitting material layer 16 as shown in FIG. 5A, by using adhesive 17 (or directly by anodic coupling or the like), prior to etching and removing unnecessary regions. As the adhesive 17, organic material such as epoxy resin and inorganic material such as low melting point glass may be used. As the material of the support substrate 18, insulating materials such as glass, quartz, silicon oxide, and silicon nitride, semiconductor materials such as Si and Ge, conductive materials such as Al and Cu, or the combination thereof may be used. As shown in FIG. 5B, it is effective to planarize the electron emitting material layer 16 by forming thereon a planarizing film 19 such as spin-on-glass (SOG). Although not shown, it is also effective to planarize the surface of the electron emitting material layer 16 by chemical mechanical polishing (CMP), or by deposition or application and etch-back of a sacrificial film of resist or SOG.

Figure 6:
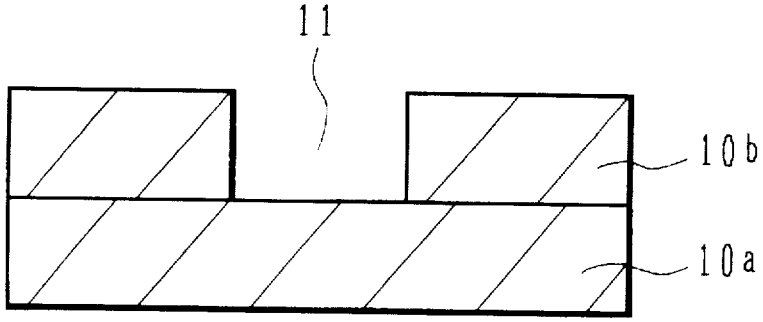
FIG. 6 is a cross sectional view of a substrate structure according to another embodiment.

In the embodiment shown in FIGS. 1A to 1F, the substrate 10 is a single layer. The substrate may be made by a laminate of stacked two layers as shown in FIG. 6. In this case, it is preferable to select a proper combination of materials of a starting substrate **10*a* and a laminated layer 10*b* so as to obtain a high etching selection ratio. If a proper combination is selected, the starting substrate 10*a* becomes an etching stopper when the recess 11 is formed, and the recess 11 having a depth same as that of the laminated film 10*b*** is obtained.

Figure 7:
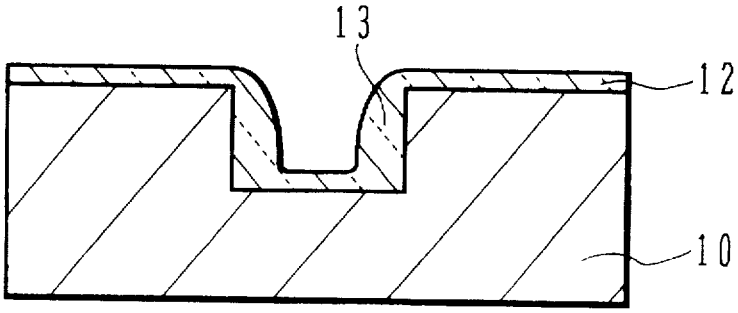
FIG. 7 is a cross sectional view of a substrate structure for illustrating processes of forming a side spacer according to another embodiment.

In the embodiment shown in FIGS. 1A to 1F, the etch-back of the first sacrificial film 12 may be stopped before the first sacrificial film 12 at the area other than the recess is completely etched. This structure is schematically shown in FIG. 7. This etching control enables to finely adjust the shape of the recess which is reflected upon the surface of the second sacrificial film, i.e., the shape of the tip of the electron emitting material layer 16.

Figure 8A:
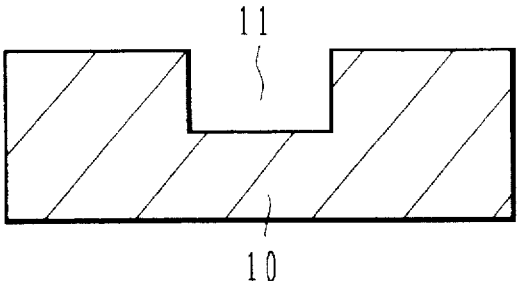
FIGS. 8A to 8F are cross sectional views of a substrate for illustrating processes of manufacturing an emitter according to another embodiment.
Figure 8B:
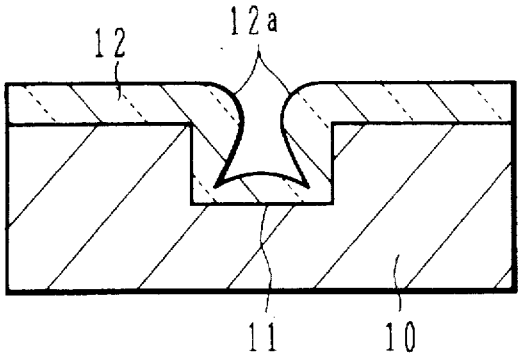

FIGS. 8A to 8F illustrate processes of manufacturing an emitter according to another embodiment of the invention. FIGS. 8A to 8F correspond to FIGS. 1A to 1F, respectively. Like elements to those shown in FIGS. 1A to 1F are represented by using identical reference numerals, and the detailed description thereof is omitted. In this embodiment, the first sacrificial film 12 is deposited by a film deposition method having poor step coverage. As shown in FIG. 8B, an overhang **12*a* is formed on an upper portion of the side wall. The deposition method having poor step coverage may be considered as a method of depositing a non-conformal film. As the non-conformal film deposition method for the first sacrificial film 12**, vacuum deposition, sputtering, and plasma CVD may be used.

Figure 8C:
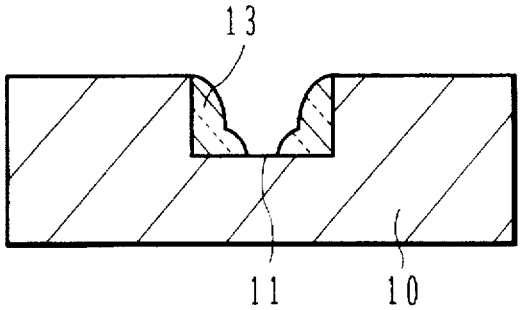
Figure 8D:
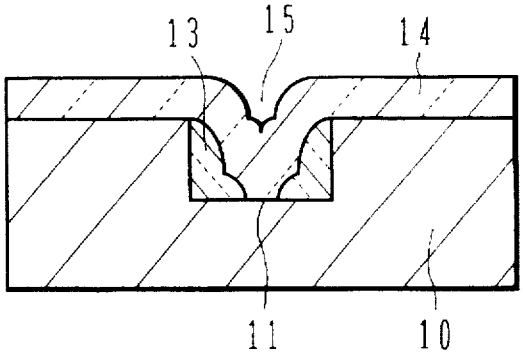

The first sacrificial film 12 with the overhang **12*a* is etched back to form a side spacer 13 such as shown in FIG. 8C. The cross section of the side spacer 13 has two-stepped arcs as shown because of the shape of the overhang 12*a*. As the second sacrificial film 14 is deposited by a film deposition method having good step coverage, a cusp 15 having a sharp apex portion is formed because of the reflection of the shape of the side spacer 13**.

Figure 8E:
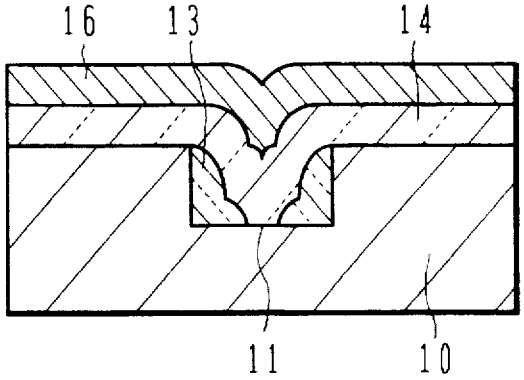
Figure 8F:
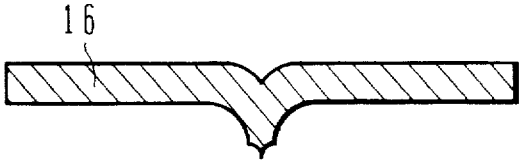

In this embodiment, as shown in FIGS. 8E and 8F, an emitter having a sharp tip with two-stepped arcs can be obtained.

Also in this embodiment, modifications similar to those shown in FIGS. 3A to 7 are possible.

Figure 9A:
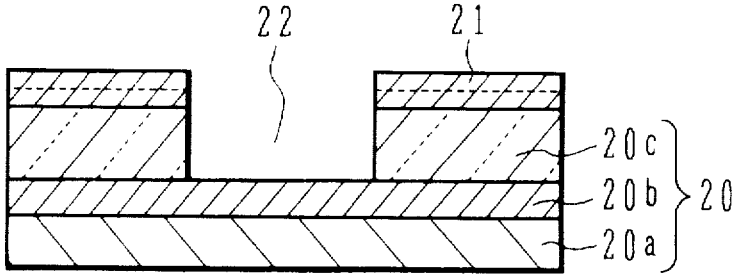
FIGS. 9A to 9G are cross sectional views for illustrating processes of manufacturing an electric field emission type device according to another embodiment.

FIGS. 9A to 9G illustrate processes of manufacturing a triode device with an anode electrode, an emitter electrode, and a gate electrode according to an embodiment of the invention. As shown in FIG. 9A, a substrate is a laminate substrate having an insulator **20*a* on which an anode electrode 20*b* and an insulating film 20*c* are laminated. Specifically, the insulator 20*a* is a plate made of silicon oxide or glass such as soda lime, the anode electrode 20*b* is made of polysilicon, and the insulating film 20*c* is made of silicon oxide. On the substrate 20, a first conductive film 21 is deposited, the first conductive film being constituted, for example, by a stack of a polysilicon film and a W silicide film, and serving as the gate electrode. Thereafter, the first conductive film 21 and the underlying insulating film 20*c* are selectively etched by RIE to form a circular recess 22 having a vertical side wall reaching the anode electrode 20*b***.

Figure 9B:
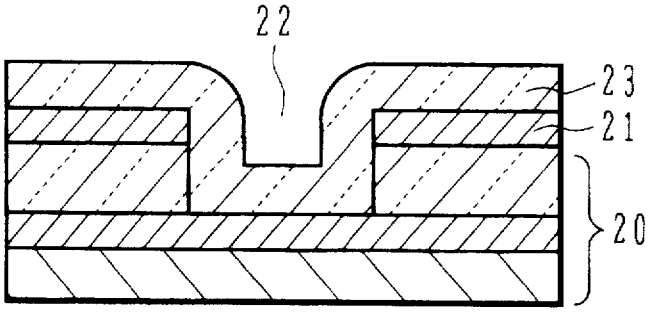
Figure 9C:
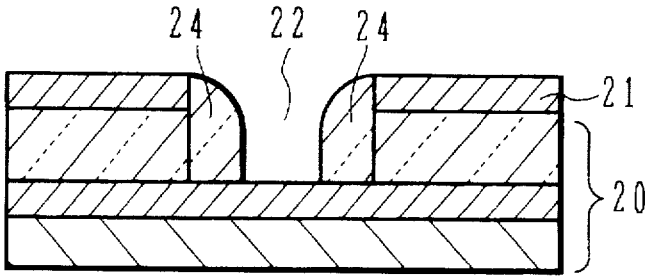
Figure 9D:
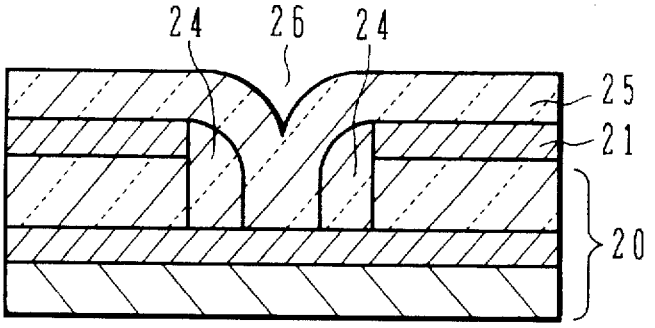

Next, as shown in FIG. 9B, a first insulating film 23 of silicon oxide is deposited by CVD. The first insulating film 23 is etched back to form a side spacer 24 on the side wall of the recess 22 as shown in FIG. 9C. This first insulating film 23 corresponds to the first sacrificial film of the first embodiment. Thereafter, as shown in FIG. 9D, a second insulating film 25 of silicon oxide is deposited by CVD. This second insulating film 25 corresponds to the second sacrificial film of the first embodiment. A cusp 26 having a sharp apex portion for forming the tip of the emitter is formed on the surface of the second insulating film 25.

Figure 9E:
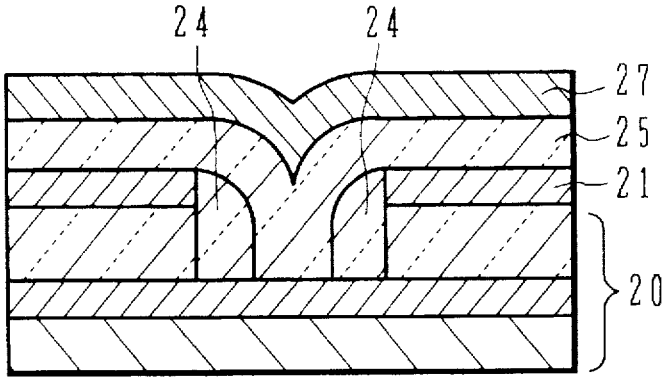
Figure 9F:
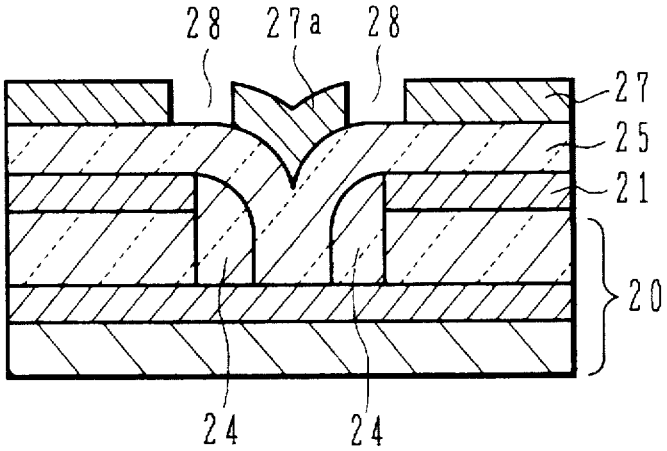

Next, as shown in FIG. 9E, a second conductive film 27 as an emitter electrode is formed on the second insulating film 25. For example, the second conductive film 27 is a laminate of a TiN film made by sputtering or CVD and a W film made by CVD. Thereafter, the second conductive film 27 is selectively etched to form slit openings 28 on the opposite sides of an emitter 27*a*, as shown in FIG. 9F. Through these slit openings 28, isotropic wet etching with buffered hydrofluoric acid (BHF) is performed to remove the second insulating film 25 used as the emitter mold, side spacer 24 made of the first insulating film, and insulating film 20*c* in the substrate 20. As a result, as shown in FIG. 9G, the tip of the emitter 27*a*, surface of the gate electrode 21, and surface of the anode electrode 20*b* are exposed.

Figure 9G:
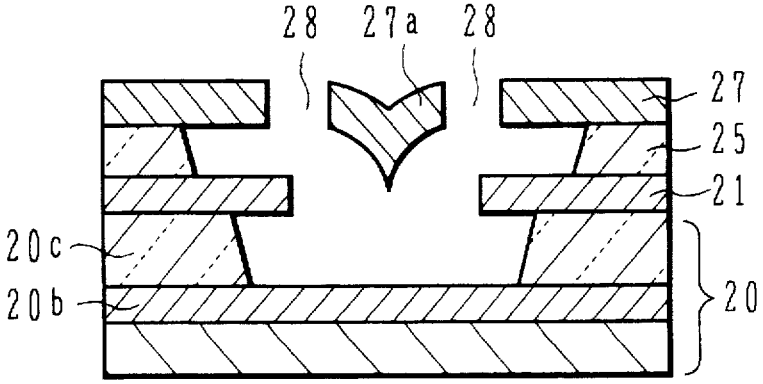
Figure 10:
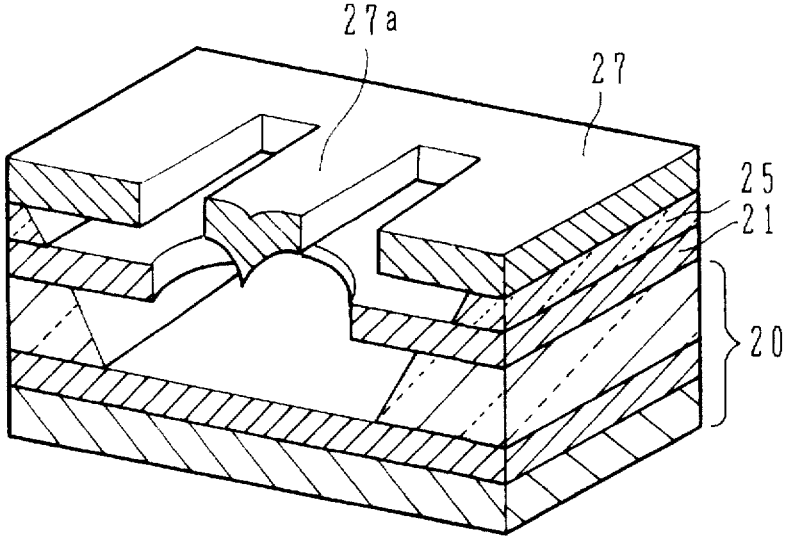
FIG. 10 is a perspective view of the structure of a device obtained by the embodiment method described with reference to FIGS. 9A to 9G.

FIG. 10 is a perspective view of the device shown in FIG. 9G. The triode element formed in the above manner is vacuum sealed to form a fine triode.

With this embodiment, an electric field emission type device can be obtained which has a high performance cold cathode type emitter self-aligned with the gate electrode.

In this embodiment, in place of polysilicon, as the material of the anode electrode 20*b*, amorphous silicon, W silicide, Mo silicide, W, Mo, Ti, Ta, Cr, and etc. may also be used. As the material of the first conductive film of the gate electrode, polysilicon, amorphous silicon, W silicide, Mo silicide, W, Mo, Ti, Ta, Cr, and etc. may also be used. As the material of the second conductive film 27 of the emitter, materials described with the first embodiment may be used. As the first and second insulating films 23 and 25 and the insulating film 20*c* in the substrate, a silicon nitride film, a laminate film of a silicon oxide film and a silicon nitride film may be used.

Figure 11A:
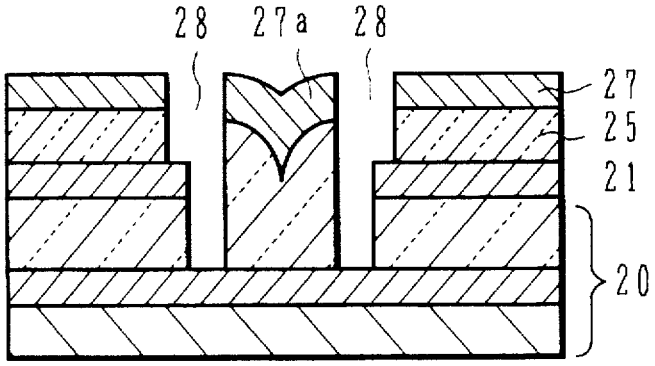
FIGS. 11A and 11B are cross sectional views for illustrating processes of manufacturing an electric field emission type device according to another embodiment.
Figure 11B:
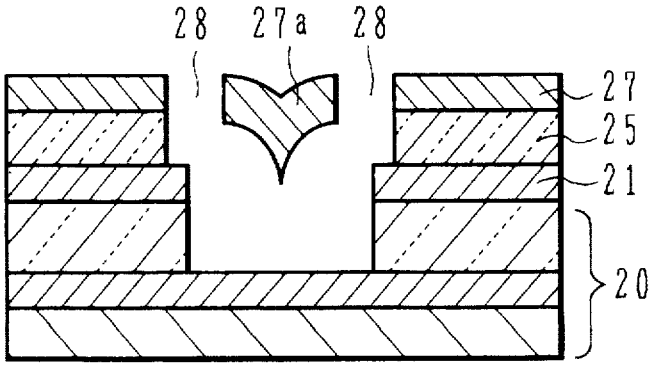

In this embodiment, although the insulating films under the emitter are removed only by isotropic wet etching at the process described with FIG. 9G, dry etching may be used in combination. For example, as shown in FIG. 11A, the insulating films just under the slit openings 28 are vertically etched by RIE, and thereafter as shown in FIG. 11B, the insulating films including the film just under the emitter are removed by isotropic wet (or dry) etching in the lateral direction.

Figure 12A:
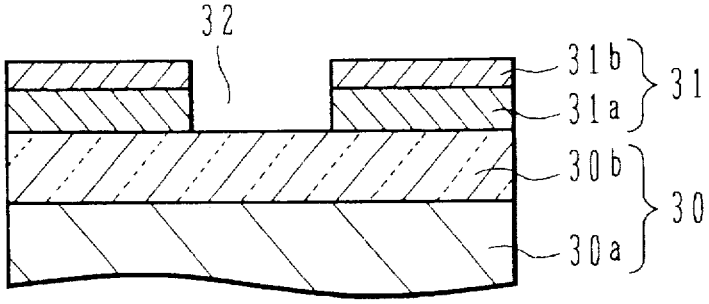
FIGS. 12A to 12H are cross sectional views for illustrating processes of manufacturing an electric field emission type device according to another embodiment.

FIGS. 12A to 12H illustrate processes of manufacturing an electric field emission type device according to another embodiment. In this embodiment, as shown in FIG. 12A, a starting substrate 30 is a laminate substrate of a silicon substrate 30*a* having a thickness of about 600 μm and a silicon oxide film 30*b* having a thickness of 450 nm thick. On this substrate 30, a film as a first conductive film 31 is formed which is constituted by a phosphorus doped polysilicon film 31*a* having a thickness of 150 nm and a W silicide film 31*b* having a thickness of 100 nm. A recess 32 having a diameter of about 0.5 μm is formed in the first conductive film 31 by lithography and RIE etching.

Figure 12B:
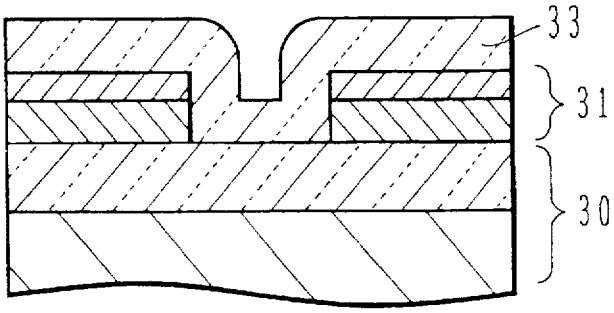

Next, as shown in FIG. 12B, a first sacrificial insulating film 33 of silicon oxide is deposited. Specifically, it is deposited to a thickness of 240 nm by using low pressure CVD using TEOS as a source gas under the conditions of a substrate temperature of 720° C. and a pressure of 50 Pa.

Figure 12C:
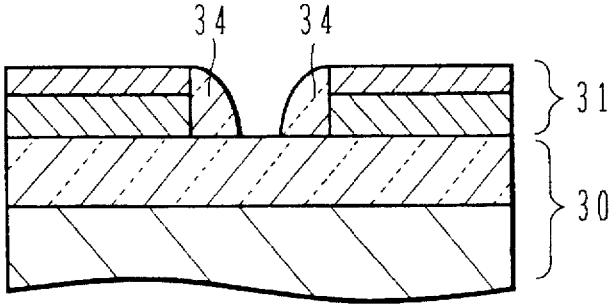

Then, the first insulating film 33 is etched back by RIE to form a side spacer 34 on the side wall of the recess 32 as shown in FIG. 12C.

Figure 12D:
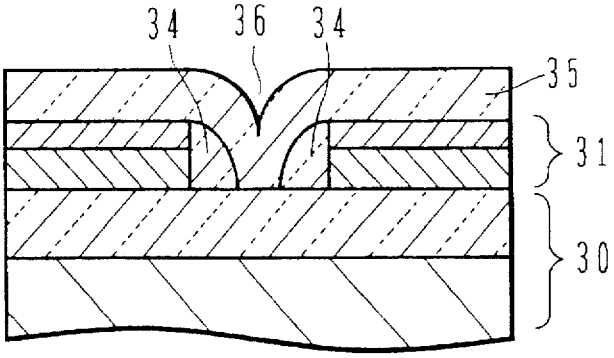

Next, as shown in FIG. 12D, a second sacrificial insulating film 35 of silicon oxide is deposited. Specifically, it is deposited to a thickness of 200 nm by atmospheric pressure CVD using source gases of TEOS, $O_3$, and $O_2$ at the substrate temperature of 400° C. A sharp cusp 36 is formed on the surface of the second insulating film 35. After the silicon oxide film of the second insulating film 35 is formed, it is heated with a lamp from the room temperature up to 850° C. in 10 seconds and maintained at 850° C. for 10 seconds.

Figure 12E:
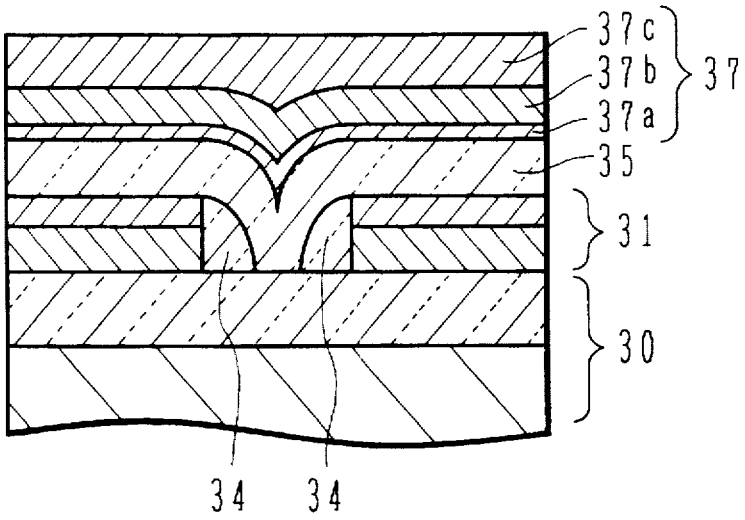

Next, as shown in FIG. 12E, a second conductive film 37 serving as an electron emitting material layer is formed. Specifically, the second conductive film 37 has a three-layer laminate structure constituted by a lower TiN film 37*a*, a middle W film 37*b*, and an upper Al film 37*c*. The TiN film 37*a* is deposited to a thickness of 50 nm by reactive sputtering in an $N_2$ atmosphere using a Ti target. The W film 37*b* is deposited to a thickness of 200 nm by CVD using $WF_6$ as a source gas. The Al film 37*c* is deposited to a thickness of 300 nm by sputtering.

Figure 12F:
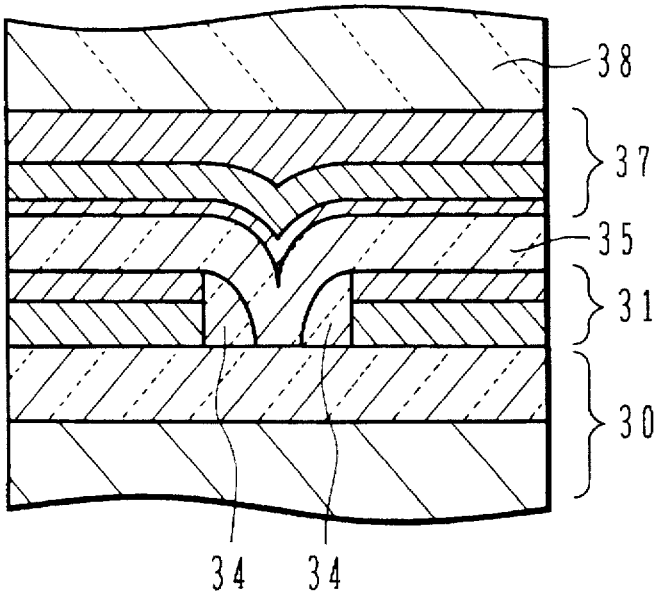

As shown in FIG. 12F, a glass substrate 38 such as of soda lime having a thickness of about 5 mm is bonded to the second conductive film 37 of a sample obtained by the above processes. Bonding is performed by heating the sample to 450° C. and by anodic coupling (electrostatic coupling) at a voltage of about 1.5 kV.

Figure 12G:
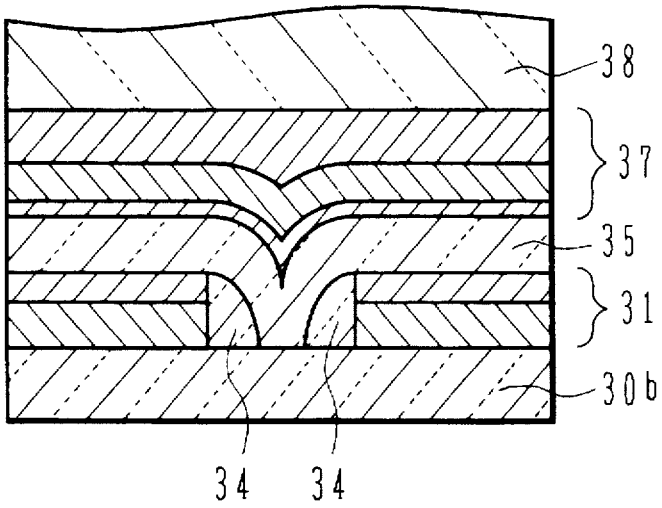

Next, as shown in FIG. 12G, the silicon substrate 30*a* is etched and removed by wet etching using aqueous solution of $HF+HNO_3+CH_3COOH$ or aqueous solution of ethylenediamine+catechol.

Figure 12H:
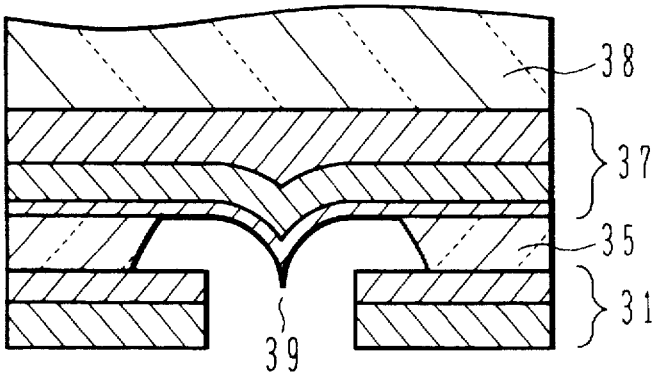

Thereafter, the silicon oxide film 30*b* is etched by using aqueous solution of $HF+NH_4F$ to expose the electron emitting material layer and its tip 39 as shown in FIG. 12H.

Figure 15A:
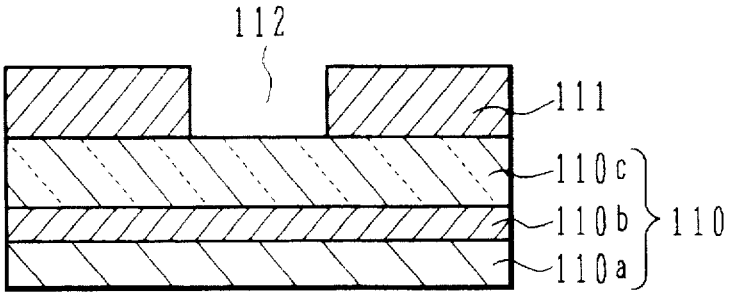
FIGS. 15A to 15G are cross sectional views for illustrating processes of manufacturing an electric field emission type device according to another embodiment of the invention.

FIGS. 15A to 15G illustrate processes of manufacturing a triode device according to another embodiment of the invention. As shown in FIG. 15A, a starting substrate 110 is a laminate of a silicon substrate 110*a*, an anode electrode 110*b*, and an insulating film 110*c*, stacked in this order from the bottom. The anode electrode 110*b* is made of polysilicon, and the insulating film 110*c* is made of silicon oxide. On this substrate 110, a first conductive layer 111 of polysilicon is deposited to a thickness of 250 nm. The first conductive film 111 is used as an underlying layer of an emitter mold and as a gate electrode. The first conductive layer 111 is etched by RIE to form a recess 112 having a vertical side wall reaching the substrate 110. The diameter of the recess 112 is, for example, 0.5 μm.

Figure 15B:
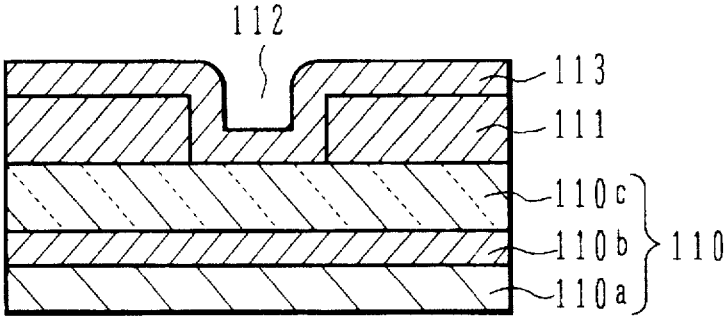
Figure 15C:
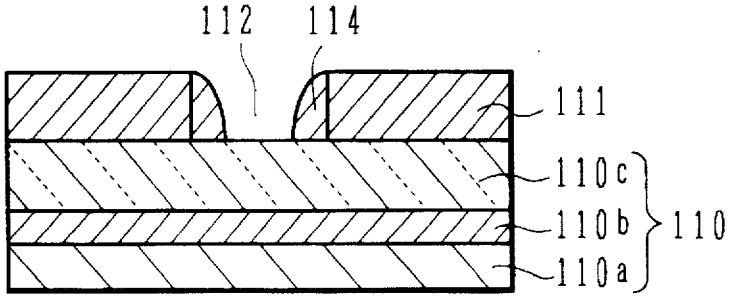
Figure 15D:
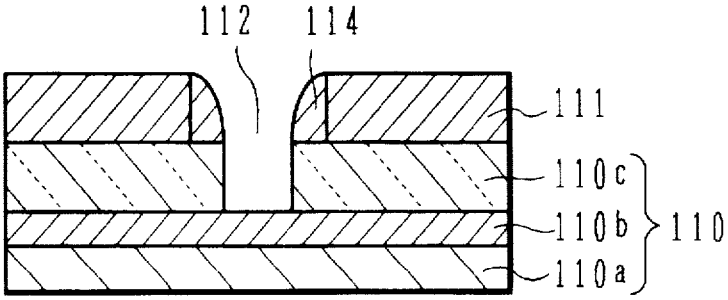

Next, a second conductive film 113 of WSi is deposited to a thickness of 150 nm, as shown in FIG. 15B, and etched back to form a side spacer 114 on the side wall of the recess 112 as shown in FIG. 15C. This side spacer 114 becomes part of the gate electrode. By using the side spacer 114 and first conductive film 111 as a mask, the insulating film 110*c* on the surface of the substrate 110 is etched as shown in FIG. 15D.

Figure 15E:
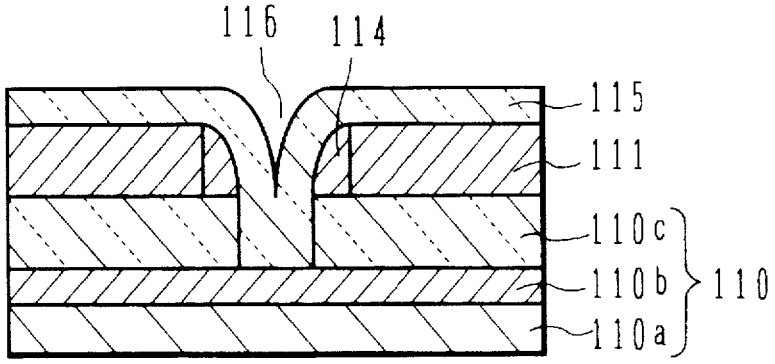

Next, as shown in FIG. 15E, an insulating film 115 of silicon oxide is deposited to a thickness of 150 nm by low pressure CVD. A cusp 116 having a sharp apex portion is formed on the surface of the insulating film 115.

Figure 15F:
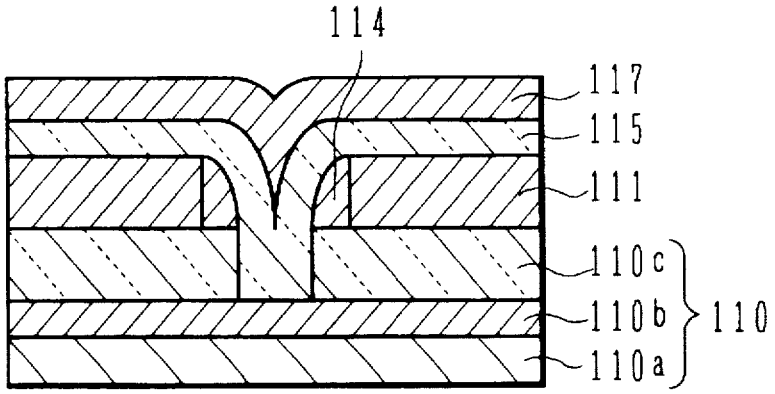

Next, as shown in FIG. 15F, a third conductive film 117 is deposited, which is a laminate structure of Ti/W/Al (from the bottom to the top), and is used as an emitter electrode.

Figure 15G:
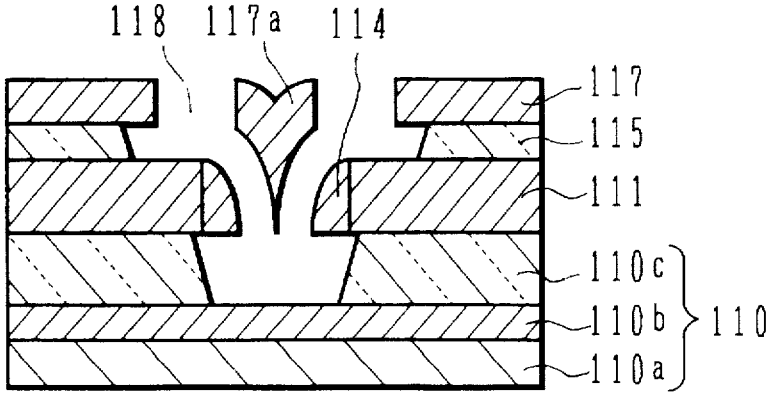

Next, as shown in FIG. 15G, the third conductive film 117 is selectively etched to form slit openings 118 on the opposite sides of an emitter 117*a*. Through these slit openings 118, etching with buffered hydrofluoric acid (BHF) is performed to remove the insulating film 115 used as the emitter mold and the insulating film 110*c* on the surface of the substrate 110. As a result, the tip of the emitter 117*a*, gate electrode surface, and anode electrode surface are exposed.

With this embodiment, since the side spacer 114 is formed under the insulating film 115 used as the emitter mold, the cusp 116 having a sharp apex portion can be formed on the surface of the insulating film 115 without thickening the film 115 so much as in the conventional method. Therefore, cracks are prevented from being formed in the insulating film 115, and an electric field emission type device having an emitter with a small apex angle and a small radius of curvature of the tip can be manufactured with good yield.

Figure 16:
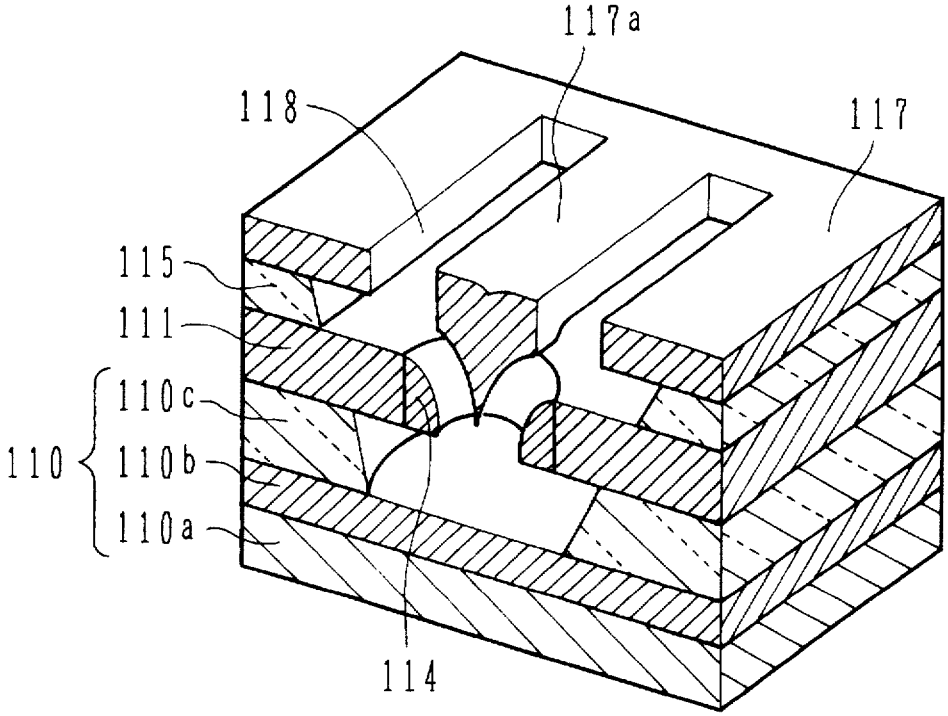
FIG. 16 is a perspective view of the structure of a device obtained by the embodiment method described with reference to FIGS. 15A to 15G.

FIG. 16 is a perspective view of a device obtained by the embodiment method described with FIGS. 15A to 15G. This device is vacuum sealed to form a fine triode. The opening of the gate electrode is small because the side spacer 114 is formed on the side wall of the recess formed in the first conductive film 111. As a result, a large emission current can be obtained with a relatively small gate-emitter voltage.

FIGS. 17A to 17H illustrate processes of manufacturing a triode device according to another embodiment of the invention. Like elements to those shown in FIGS. 15A to 15G are represented by using identical reference numerals, and the detailed description is omitted.

Figure 17A:
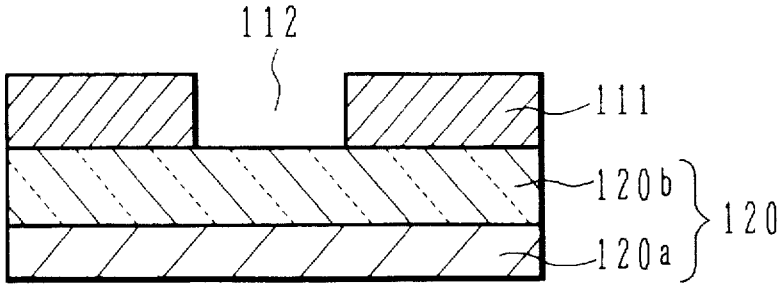
FIGS. 17A to 17H are cross sectional views for illustrating processes of manufacturing an electric field emission type device according to another embodiment of the invention.
Figure 17B:
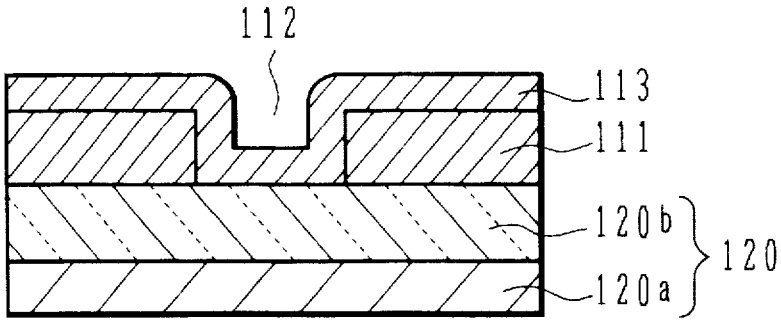
Figure 17C:
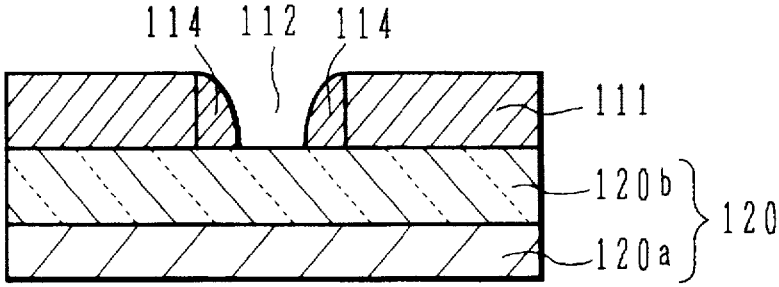

In this embodiment, as shown in FIG. 17A, a starting substrate 120 has a silicon substrate 120*a* without an anode electrode and an insulating film 120*b* of silicon oxide. Similar to the embodiment shown in FIGS. 15A to 15G, a first conductive film 111 is deposited and a recess 112 is formed (FIG. 17A), the first conductive film 111 being used as a gate electrode. A second conductive film 113 is deposited (FIG. 17B) and etched back to form a side spacer 114 (FIG. 17C).

Figure 17D:
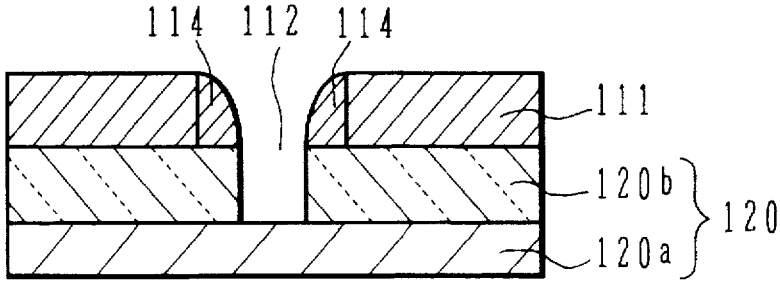
Figure 17E:
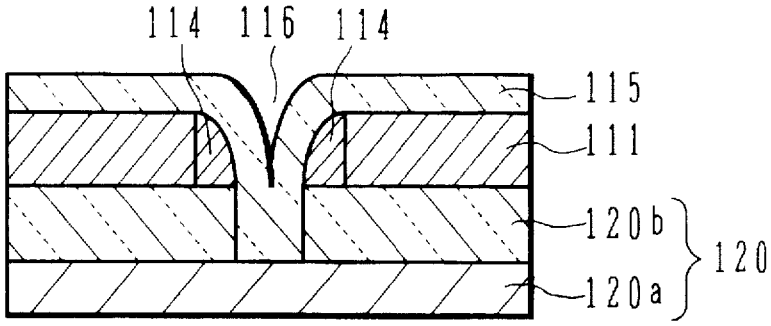

Next, by using the side spacer 114 and first conductive film 111 as a mask, the insulating film 120*b* in the substrate 120 is etched to form a recess (FIG. 17D). Next, as shown in FIG. 17E, an insulating film 115 is deposited under the same conditions as in the embodiment shown in FIGS. 15A to 15G. A sharp cusp 116 conformal to the shape of the side spacer 114 is therefore formed on the surface of the insulating film 115. Next, a third conductive film 117 as an emitter electrode is deposited (FIG. 17F), and thereafter the silicon substrate 120*a* is etched and removed (FIG. 17G).

Figure 17F:
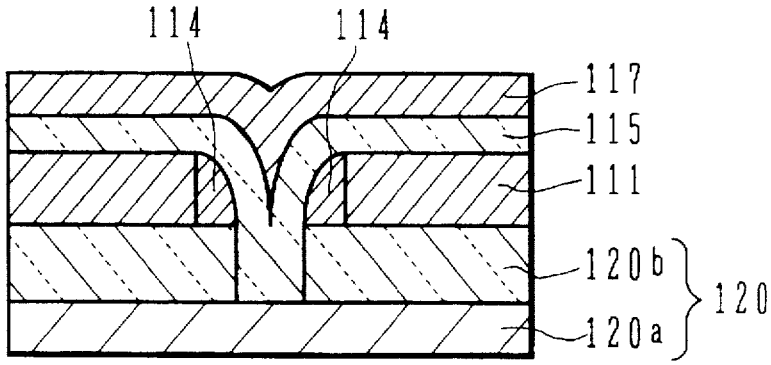
Figure 17G:
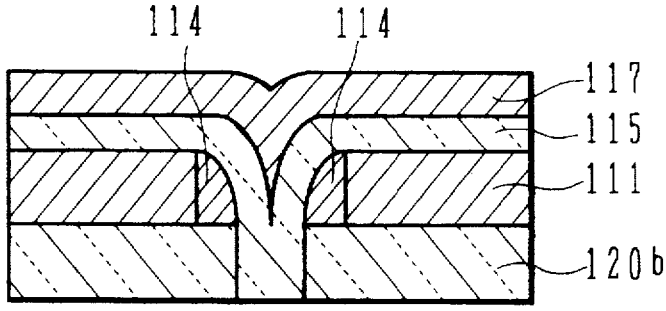
Figure 17H:
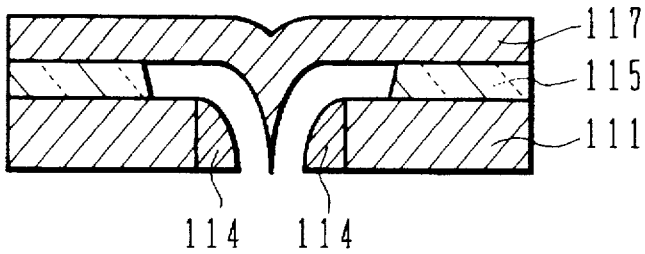

Lastly, the insulating films 115 and 120*b* are etched to expose the emitter electrode 117 as shown in FIG. 17H.

Although not shown, it is preferable to bond a support substrate such as a glass substrate to the third conductive film 117 serving as the emitter electrode, for example, by anodic coupling after the process shown in FIG. 17F. With this support substrate, the thin device can be protected and handling processes become easier.

Figure 18:
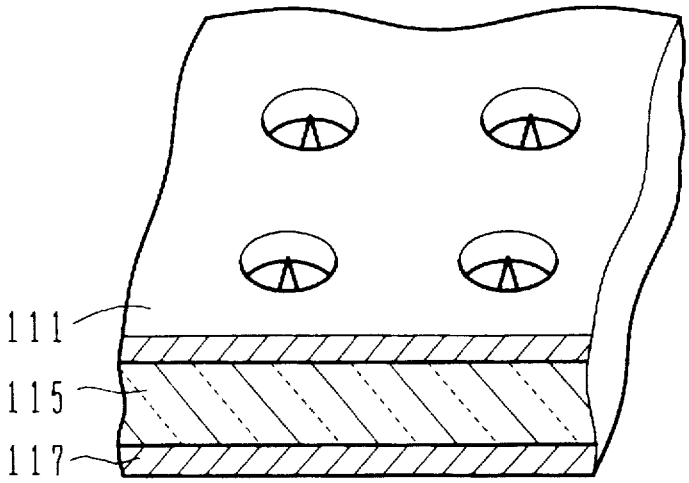
FIG. 18 is a perspective view of the structure of a device obtained by the embodiment method described with reference to FIGS. 17A to 17H.

FIG. 18 is a perspective view of an FEA obtained by this embodiment method. With this embodiment, an FEA can be realized with good manufacture yield, the FEA having a fine and high performance emitter and a gate electrode self-aligned with the emitter tip at a fine gap.

In this embodiment, in place of the first conductive layer 111 serving as the gate electrode, a two-layer structure may be used which is constituted by an underlying insulating film and a conductive film. In this case, the underlying insulating film may be made of the same material as the insulating film 115 used as the emitter mold, and is removed at the same time when the insulating film 115 is etched. The final structure changes from FIG. 17H to FIG. 19A.

Figure 19A:
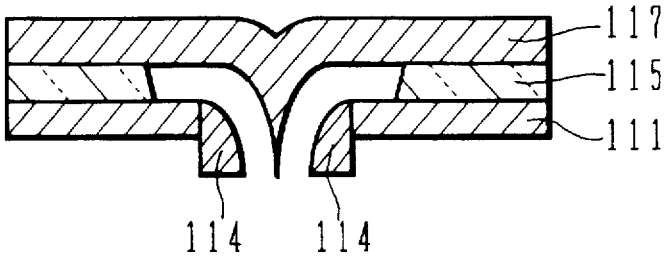
FIGS. 19A and 19B are cross sectional views of the structures of devices according to other embodiments.
Figure 19B:
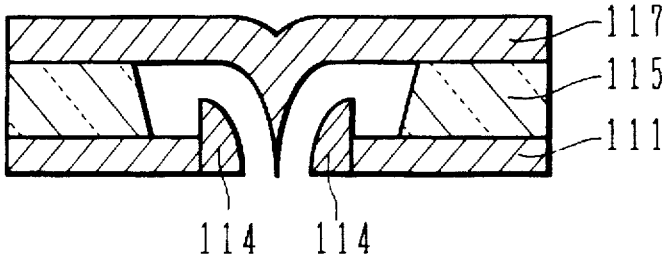

In this embodiment, the first and second conductive films 111 and 113 may be made of different materials, and the first conductive film 111 is partially etched at the etch-back process for forming the side spacer 114 shown in FIG. 17C. The final structure in this case is shown in FIG. 19B.

In the embodiment shown in FIGS. 15A to 15G, after the side spacer 114 is formed by etching back the second conductive film 113 as shown in FIG. 15C, the insulating film 110*c* is etched to obtain the structure shown in FIG. 15D. This etching of the insulating film 110*c* may be used to remove the skirt portion, if any, of the side spacer 114 so that the apex portion of the cusp 116 can be made sharp at the process of depositing the insulating film 115 shown in FIG. 15E. In this case, the insulating film 110*c* is over-etched to remove the skirt portion of the side spacer 114, and so the etching process shown in FIG. 15D is not necessarily performed to etch the whole of the insulating film 110*c*.

Figure 20:
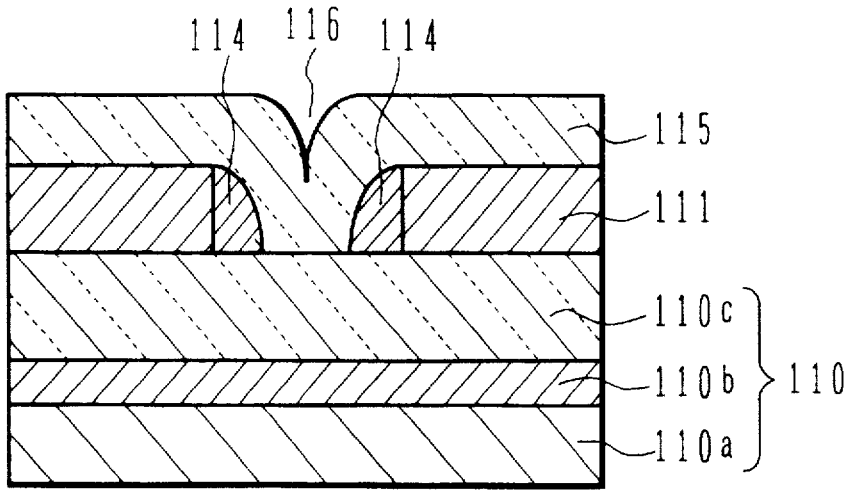
FIG. 20 is a cross sectional view of the structure of a device according to another embodiment.

If the insulating film 110*c* is not etched at the process shown in FIG. 15D and the insulating film 115 is deposited thereafter, the structure changes as shown in FIG. 20. In this case also, if the skirt portion of the side spacer 114 is not formed, the apex portion of the cusp 116 can be made sufficiently sharp. In this case, it is preferable to deposit the insulating film 115 by a film deposition method having poor step coverage, such as sputtering.

Figure 21:
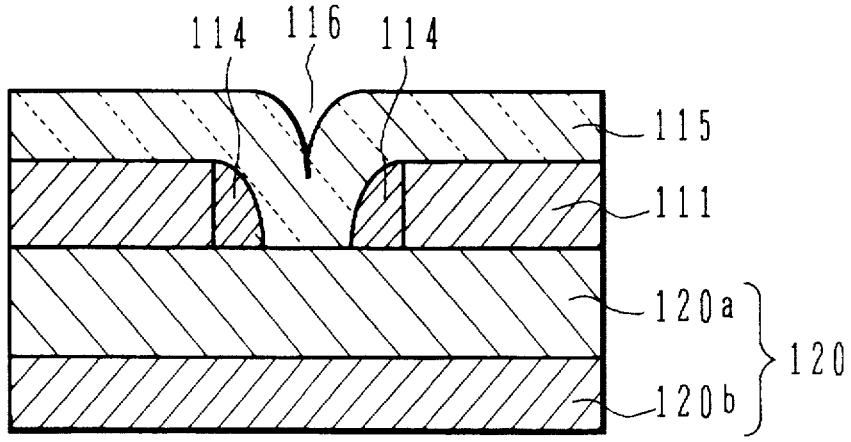
FIG. 21 is a cross sectional view of the structure of a device according to another embodiment.

These modifications are also applicable to the embodiments described with FIGS. 17A to 17H. Specifically, after the process shown in FIG. 17C, the insulating film 120*b* is not etched and the insulating film 115 is deposited directly to form the structure shown in FIG. 21.

Figure 22A:
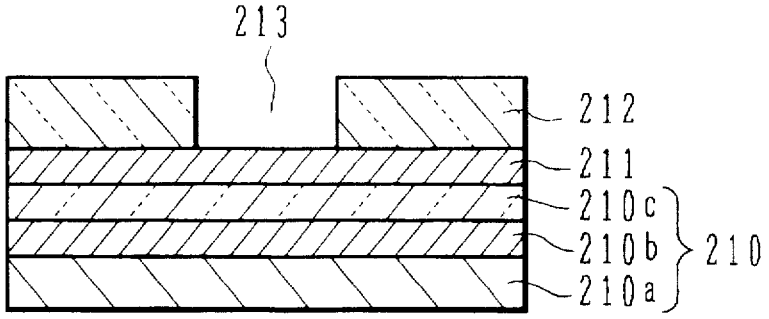
FIGS. 22A to 22G are cross sectional views for illustrating processes of manufacturing an electric field emission type device according to another embodiment of the invention.

FIGS. 22A to 22G illustrate processes of manufacturing an electric field emission type device according to another embodiment of the invention. As shown in FIG. 22A, a substrate 210 is a laminate substrate including a silicon substrate 210*a*, an anode electrode 210*b*, and an insulating film 210*c*, stacked in this order from the bottom. Specifically, the anode electrode 210*b* is made of polysilicon, amorphous silicon, W silicide, Mo silicide, W, Mo, Ti, Ta, Cr, or other materials. The insulating film 210*c* is made of silicon oxide. An insulating substrate made of glass, quartz, or other materials may also be used in place of the silicon substrate 210*a*.

As shown in FIG. 22A, on the substrate 210, a laminate film of a polysilicon film and a W silicide film is deposited as a first conductive layer 211 which is used as a gate electrode. Then, a silicon nitride film 212 is deposited as a first insulating film. A recess 213 is formed in the first insulating film 212 by lithography and RIE, the recess having a vertical or a generally vertical side wall reaching the first conductive film 211.

Figure 22B:
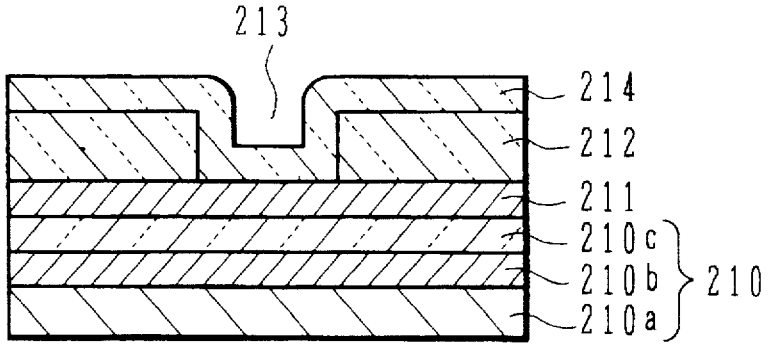
Figure 22C:
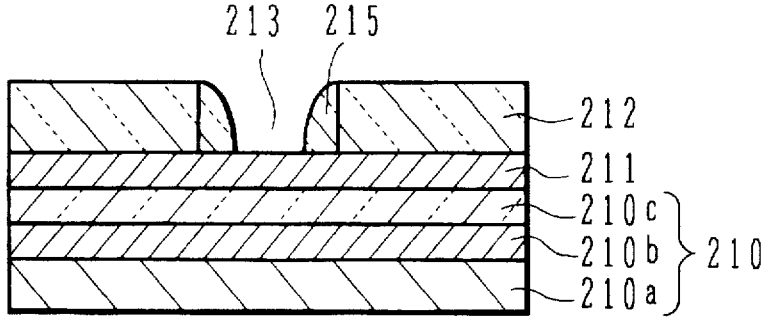

Next, as shown in FIG. 22B, a second insulating film 214 is deposited on the substrate with the recess 213. The second insulating film 214 is a silicon nitride film formed by a film deposition method having good step coverage such as CVD. This second insulating film 214 is etched back by RIE to form a side spacer 215 as shown in FIG. 22C.

Figure 22D:
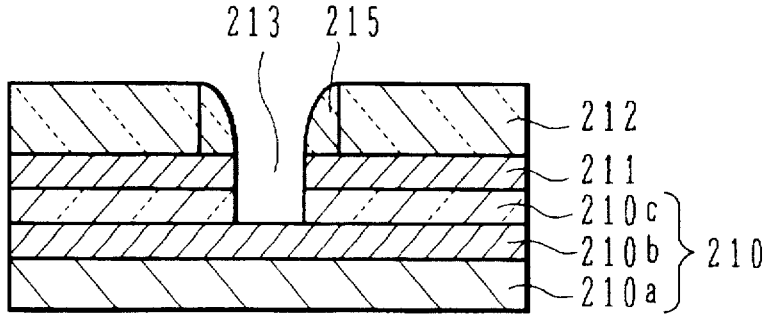

Next, as shown in FIG. 22D, by using the side spacer 215 and first insulating film 212 as a mask, the first conductive film 211 exposed in the recess 213 is selectively etched by dry or wet etching to form a gate electrode pattern. An opening 213*b* smaller in diameter than the initial recess 13 is therefore formed in the center of the gate electrode because of the presence of the side spacer 215. In this embodiment, the insulating film 210*c* on the anode electrode 210*b* is also etched.

The insulating film 210*c* is not necessarily required to be etched at this process. If the insulating film 210*c* is to be etched, etching gas different from the etching gas for the first conductive film 211 is used. In this case, since the different materials are used for the insulating film 210*c*, and the first insulating film 212 and side spacer 215, the etching condition can be set so as to have a sufficiently large etching selection ratio of the insulating film 210*c* to the first insulating film 212 and side spacer 215. Therefore, the insulating film 210*c* can be etched without etching the first insulating film 212 and side spacer 215.

Figure 22E:
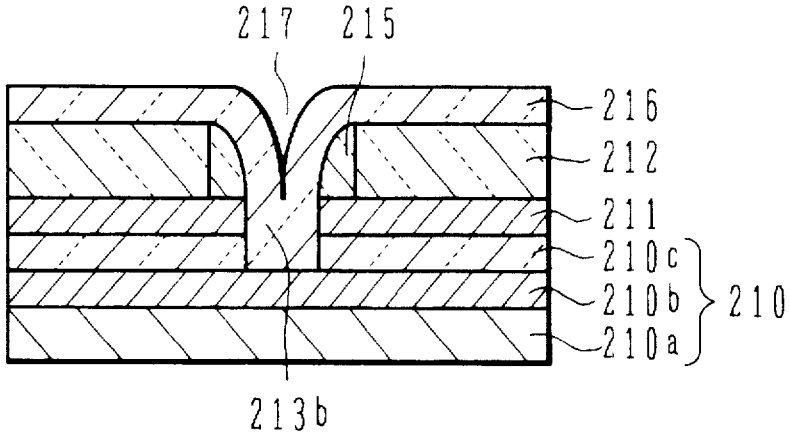

Next, as shown in FIG. 22E, a third insulating film 216 serving as an emitter mold is deposited. The third insulating film 216 is formed by a film deposition method having poor step coverage such as sputtering. The third insulating film 216 is made of silicon oxide same as the insulating film 210c in the substrate 210. A cusp 217 having a sharp apex portion is therefore formed on the surface of the third insulating film 216.

Figure 22F:
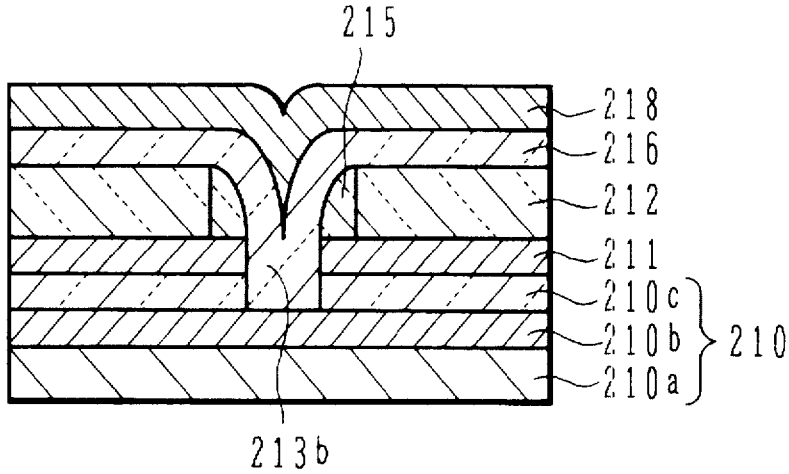

Next, as shown in FIG. 22F, a second conductive film 218 serving as an emitter electrode is deposited on the third insulating film 216. The second conductive film 218 is a laminate film of TiN/W/Al.

Figure 22G:
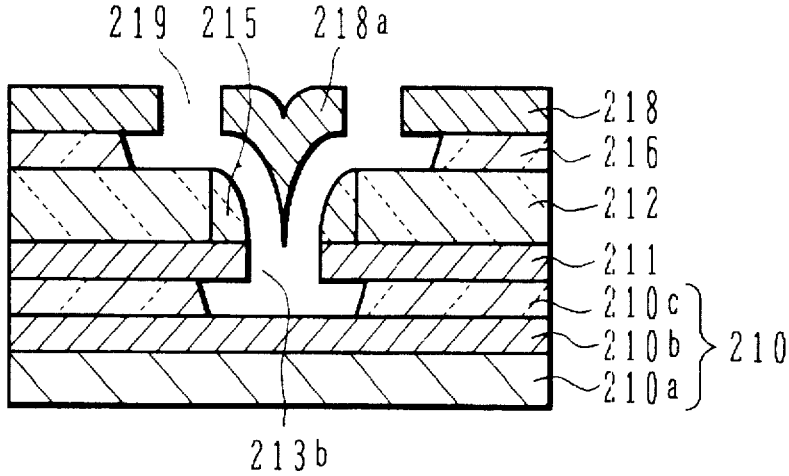

Next, as shown in FIG. 22G, the second conductive film 218 is selectively etched to form slit openings 219 on the opposite sides of the portion of the conductive film 218 functioning as an actual emitter tip 218a. Through these slit openings 219, the third insulating film 216 used as the emitter mold is etched until the end surface of the gate electrode 211 and the anode electrode 210b are exposed. In this manner, unnecessary regions between the emitter 218a and the anode electrode 210b are removed and a hollow portion is formed in the device. In this case, wet etching with buffered hydrofluoric acid (BHF) is used as an etching method having a large etching selection ratio relative to the first insulating film 212 and side spacer 215. With this etching, as shown in FIG. 22G, the third insulating film 216 under the second conductive film 218 and the insulating film 210c on the anode electrode 210b can be laterally etched and retracted appropriately.

Figure 23:
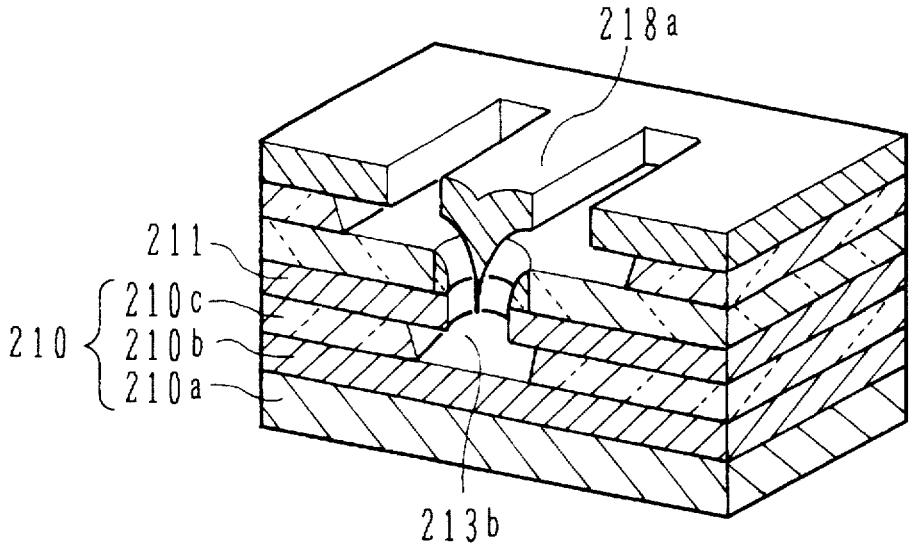
FIG. 23 is a perspective view of a device obtained by the embodiment method described with reference to FIGS. 22A to 22G.

FIG. 23 is a perspective view of a device obtained by the embodiment described with FIGS. 22A to 22G. This device is vacuum sealed to form a fine triode.

With this embodiment, an electric field emission type device can be obtained which has a high performance cold cathode self-aligned and integrally formed with a gate electrode. The opening 213b of the gate electrode 211 surrounding the emitter tip is smaller than the diameter of the initial recess 213 because the recess 213b is formed by using the side spacer 215 as the mask. This means that the distance between the gate electrode 211 and the tip of the emitter 218a shortens. Therefore, it is possible to efficiently emit electrons even if a control voltage applied to the gate electrode 211 is low.

Figure 24:
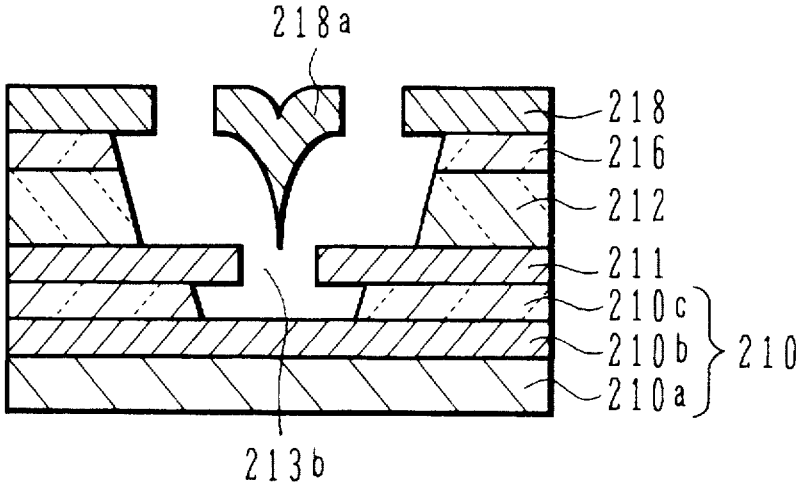
FIG. 24 is a cross sectional view of a device according to another embodiment.

After the process shown in FIG. 22G, the first insulating film 212 and side spacer 215 may be etched to obtain the structure shown in FIG. 24.

If the insulating film 210c in the substrate 210, first insulating film 212, second insulating film 214 for forming the side spacer 215, and third insulating film 216 used as the emitter mold are all made of silicon oxide and the wet etching process of FIG. 22G with BHF solution is performed, the device structure shown in FIG. 24 is obtained.

Figure 25A:
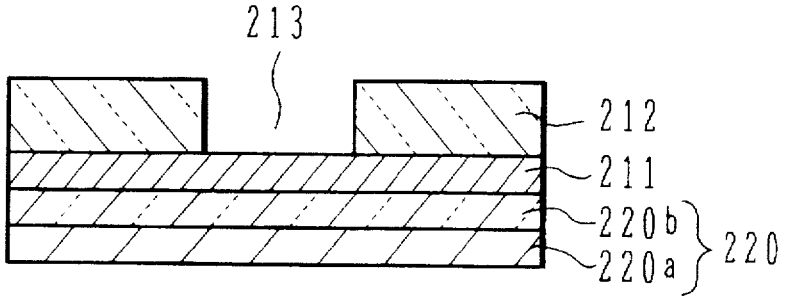
FIGS. 25A to 25H are cross sectional views for illustrating processes of manufacturing an electric field emission type device according to another embodiment of the invention.
Figure 25B:
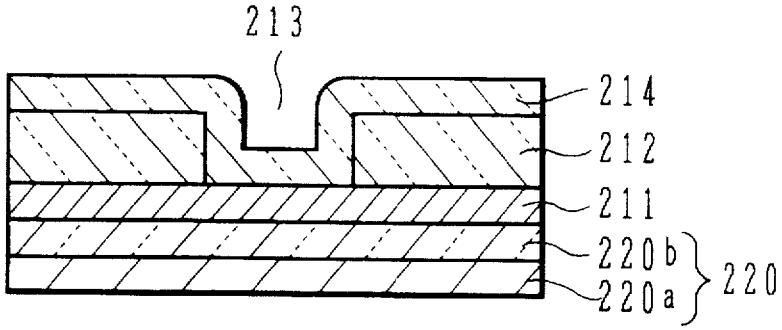
Figure 25C:
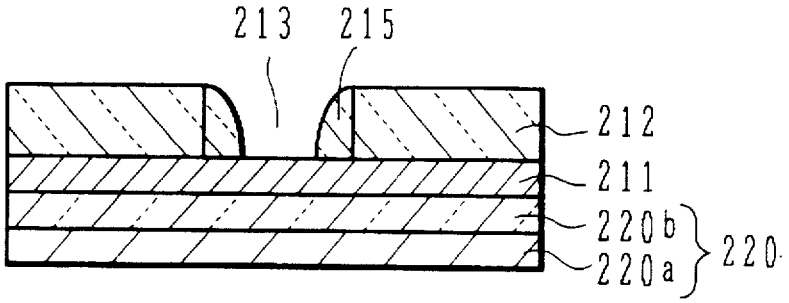
Figure 25D:
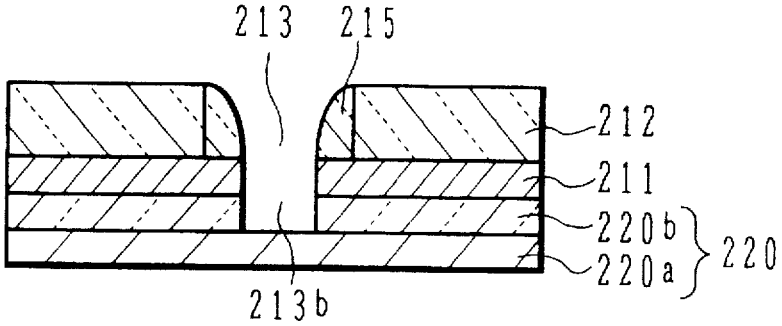
Figure 25E:
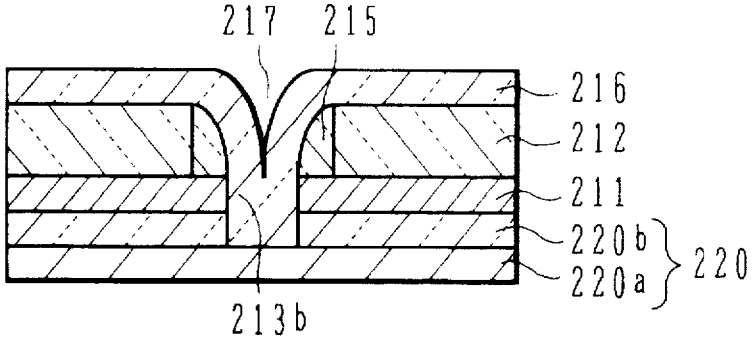

FIGS. 25A to 25H illustrate processes of manufacturing an electric field emission type device according to another embodiment of the invention. Like elements to those of the embodiment described with FIGS. 22A to 22G are represented by using identical reference numerals, and the detailed description thereof is omitted. In this embodiment, as shown in FIG. 25A, a starting substrate 220 has a silicon substrate 220a and an insulating film 220b formed on the silicon substrate 220a. Similar to the embodiment described with FIGS. 22A to 22G, a first conductive film 211 and a first insulating film 212 are deposited on the substrate 220, and the first insulating film 212 is selectively etched to form a recess 213 (FIG. 25A). A second insulating film 214 is deposited (FIG. 25B) and etched back to form a side spacer 215 (FIG. 25C). The first conductive film 211 is etched to form a gate electrode pattern (FIG. 25D).

Figure 25F:
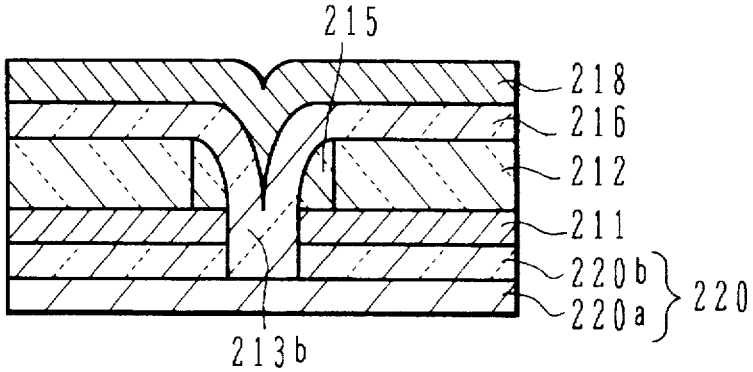
Figure 25G:
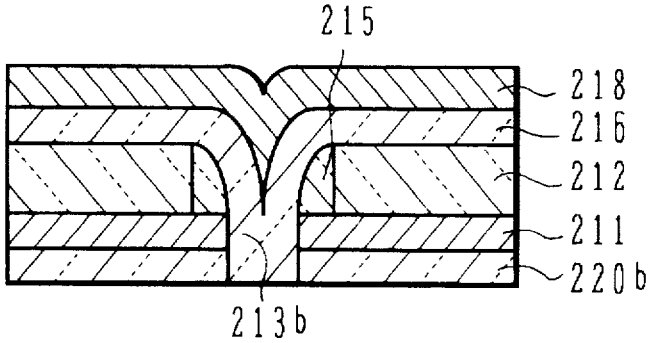
Figure 25H:
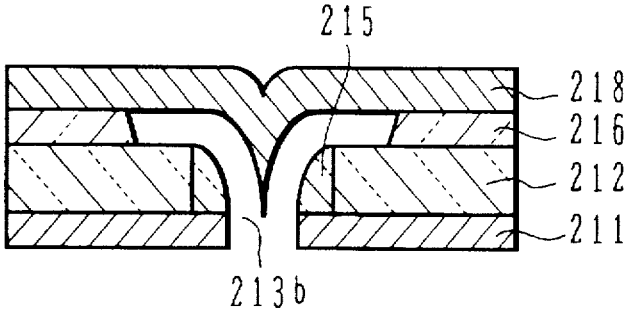

Similar to the embodiment described with FIGS. 22A to 22G, a third insulating film 216 is deposited (FIG. 25E), and a second conductive film 218 serving as an emitter electrode is deposited (FIG. 25F). Thereafter, as shown in FIG. 25G, the silicon substrate 220a is etched and removed. The exposed insulating film 220b and the third insulating film 216 used as the emitter mold are etched to expose the emitter tip and the gate end surface as shown in FIG. 25H. Also in this case, the etching condition is set so as to make the etching rate of the insulating film 220b and third insulating film 216 sufficiently faster than that of the side spacer 215 and first insulating film 212. Under these conditions, the third insulating film 216 is appropriately retracted and the emitter tip can be exposed.

It is preferable to bond, after the process shown in FIG. 25F, an insulating support substrate made of glass or the like to the second conductive film 218 serving as the emitter electrode to thereby facilitate handling of the device and improve the mechanical strength of the device. For example, a glass support substrate may be bonded by anodic bonding or coupling.

Figure 26:
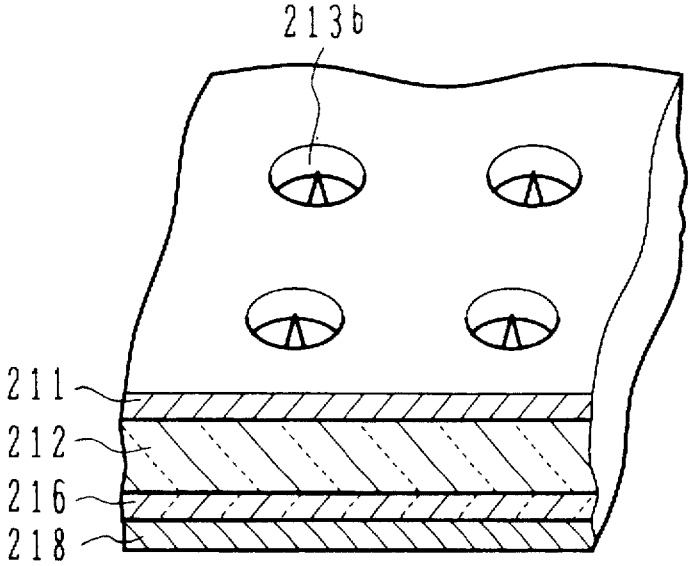
FIG. 26 is a perspective view of a device obtained by the embodiment method described with reference to FIGS. 25A to 25H.

FIG. 26 is a perspective view of an FEA obtained by the embodiment described with FIGS. 25A to 25H. The opening 213b of the gate electrode 211 is made smaller than the diameter of the initial recess 213, and the tip of the emitter electrode 218 is positioned at the center of the opening 213b. This FEA is faced with an anode having a fluorescent member and vacuum sealed to obtain a flat panel display.

Figure 27:
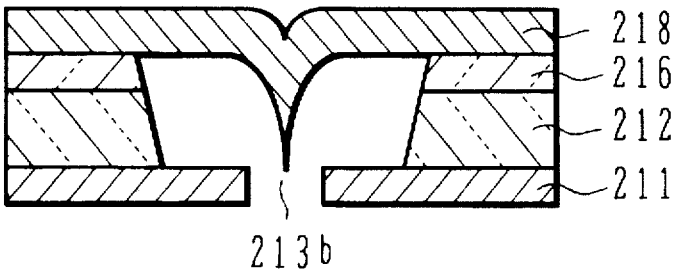
FIG. 27 is a cross sectional view of a device according to another embodiment.
Figure 28:
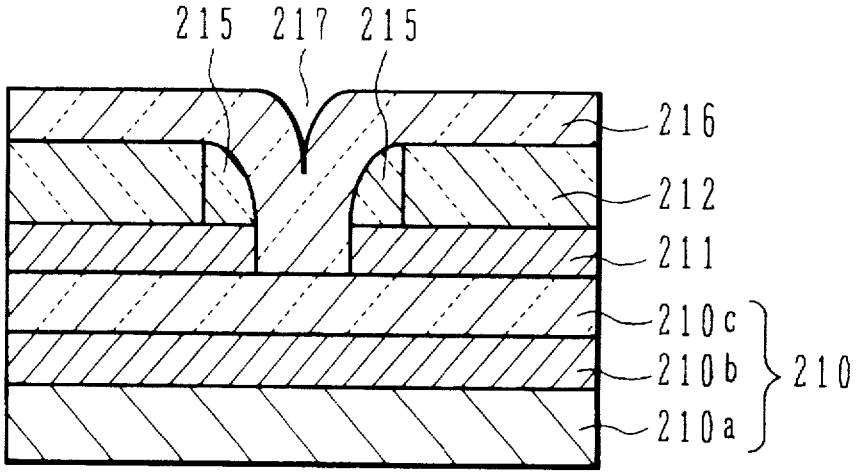
FIG. 28 is a cross sectional view of a device according to another embodiment.

If a combination of the insulating film material and the etching conditions is properly selected and the side spacer 215 and first insulating film 212 are etched at the same time when the third insulating film 216 is etched at the process shown in FIG. 25H, then the device structure shown in FIG. 27 can be obtained.

In the above embodiments, the laminate structure of TiN/W/Al is used as the emitter electrode. The structure is not limited only to this, but other metal materials (Al, Cu, W, Mo, Au, Pt, Ag, Ti, Ta, Re, Cr, Hf, Y, Bi, Sr, Tl, Pb, Ca, Sn, Ge, and etc.) or compounds thereof, semiconductor material (Si, Ge, GaAs, InSb, InAs, InSe, etc.), silicide materials ($WSi_2$, $MoSi_2$, $TiSi_2$, $TaSi_2$, NiSi, $CoSi_2$, etc.) and dielectric materials (diamond, diamond-like-carbon (DLC), $BaTiO_3$, $LiNbO_3$, etc.) may be used singularly or as a laminate structure. A resistor layer such as polysilicon may be interposed between the tip and base of the emitter electrode. Other conductive materials may be used as the materials of the gate electrode and anode electrode.

In the embodiment described with FIGS. 22A to 22G, in patterning the gate electrode by using the side spacer 215 as a mask, the insulating film 210c under the gate electrode is also etched as shown in FIG. 22D. It is not essential to etch the insulating film 210c. Without etching the insulating film 210c, the third insulating film 216 may be deposited. In this case, the device structure changes from FIG. 22E to FIG. 28.

Figure 29:
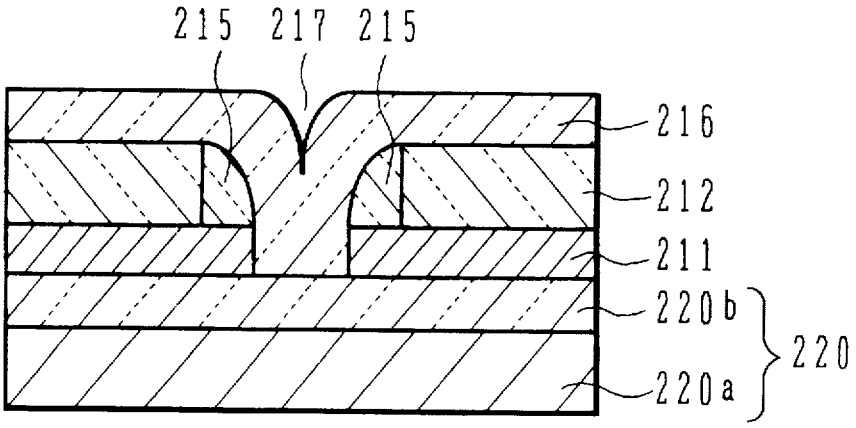
FIG. 29 is a cross sectional view of a device according to another embodiment.

Similarly, in the embodiment described with FIGS. 25A to 25H, after the gate electrode is patterned without etching the insulating film, the next insulating film may be deposited. In this case, the device structure changes from FIG. 25E to FIG. 29. In the case of the structures shown in FIGS. 28 and 29, the apex portion of the cusp 217 can be made sharp if the third insulating film 216 is deposited by a film deposition method having poor step coverage such as sputtering.

Figure 13:
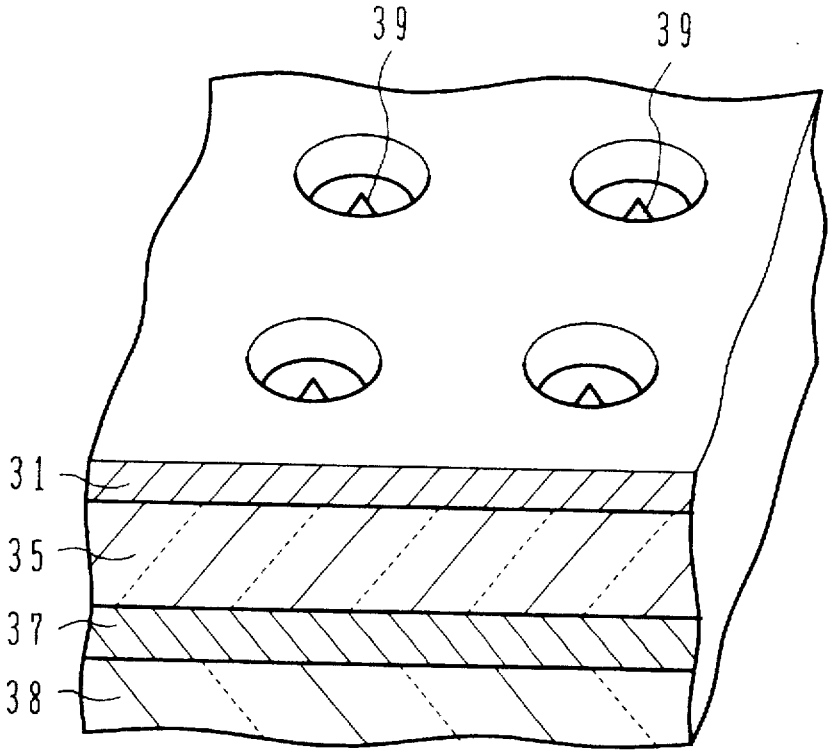
FIG. 13 is a perspective view of the structure of a device obtained by the embodiment methods.

FIG. 13 is a perspective view of an FEA obtained by the above-described embodiments. As shown, fine emitter tips 39 of a cone shape are disposed in a plurality of gate openings in a self-alignment way. For example, the radius of curvature of the emitter tip 39 is about 10 nm and the apex angle is 20 degrees or smaller. The diameter of the gate electrode is about 0.6 μm, and the distance between the gate electrode and emitter is about 0.3 μm.

Figure 14A:
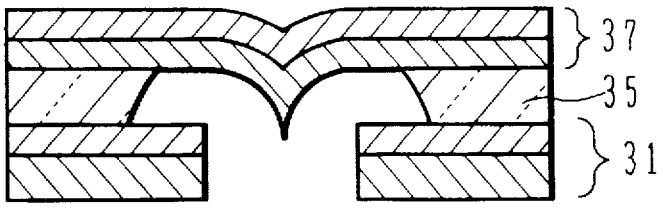
FIGS. 14A to 14C are cross sectional views of modifications of the structure of the device shown in FIG. 13.
Figure 14B:
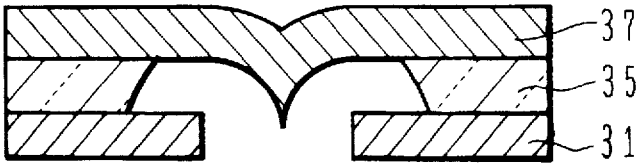
Figure 14C:
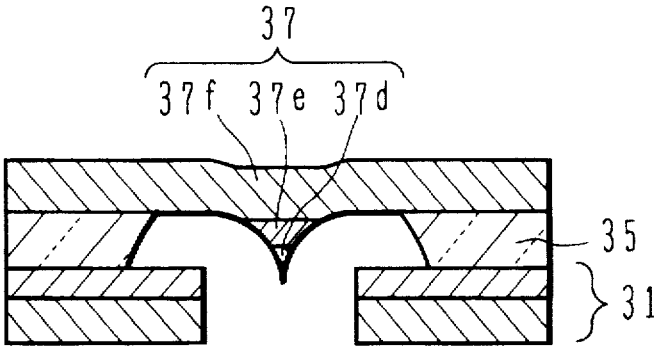

FIGS. 14A to 14C show the device structure slightly modified from the above embodiments. The device shown in FIG. 14A has a two-layer structure of the second conductive film 37 serving as the emitter electrode. The device shown in FIG. 14B has a single-layer structure for both the first conductive film 31 serving as the gate electrode and the second conductive film 37 serving as the emitter electrode. The device shown in FIG. 14C has a three-layer structure of the second conductive layer 37 serving as the emitter electrode wherein only the partial portion of the emitter tip is made of a material optimum to electric field emission such as a W film 37*d*, and a resistor film 37*e* such as amorphous silicon is interposed between an Al film 37*f* and the W film 37*d*.

The device illustrated in FIG. 14 (a) to (c) is formed as follows:

(a) As shown in FIG. 14(*a*), a TiN layer is deposited to a thickness of 200 nm by reactive sputtering in an $N_2$ atmosphere using a Ti target. Further, a polysilicon layer is deposited to a 200 nm to be served as the laminated second conductive film 37. Instead of polysilicon layer, an amorphous layer can be used.

(b) As shown in FIG. 14(*b*), a polysilicon layer is deposited to a thickness of 150 nm by reduced pressure CVD to be served as the first conductive film for the gate. Subsequently, the polysilicon layer is doped with P to raise the conductivity. A TiN layer is deposited to a thickness of 50 nm by reactive sputtering in an $N_2$ atmosphere using a Ti target to be served as the second conductive film 37.

(c) As shown in FIG. 14(*c*), a TiN layer is deposited to a thickness of 50 nm by reactive sputtering in an $N_2$ atmosphere using a Ti target. The TiN layer is used as a glue layer for a subsequently formed W film. A tungsten layer is deposited to a thickness of 200 nm by CVD in a blanket manner and the deposited tungsten layer is etched back by 200 nm to leave a W film 37*d* only in the bottom of the slope of the sacrificial film 35. Further, a polysilicon layer is deposited to a thickness of 200 nm and the deposited polysilicon layer is etched back by 200 nm on a flat portion to leave the resistor film 37*e* only in the bottom of the slope of the sacrificial film 35. Instead of polysilicon, amorphous silicon may be used. Finally, the Al film 37*f* is deposited to a thickness of 800 nm.

In the above embodiments, instead of the silicon substrate, an insulating substrate such as glass and quartz may be used. A conductive substrate may also be used. Instead of a silicon oxide film, a silicon nitride film, a laminate of a silicon oxide film and a silicon nitride film, or other films may be used.

Figure 30:
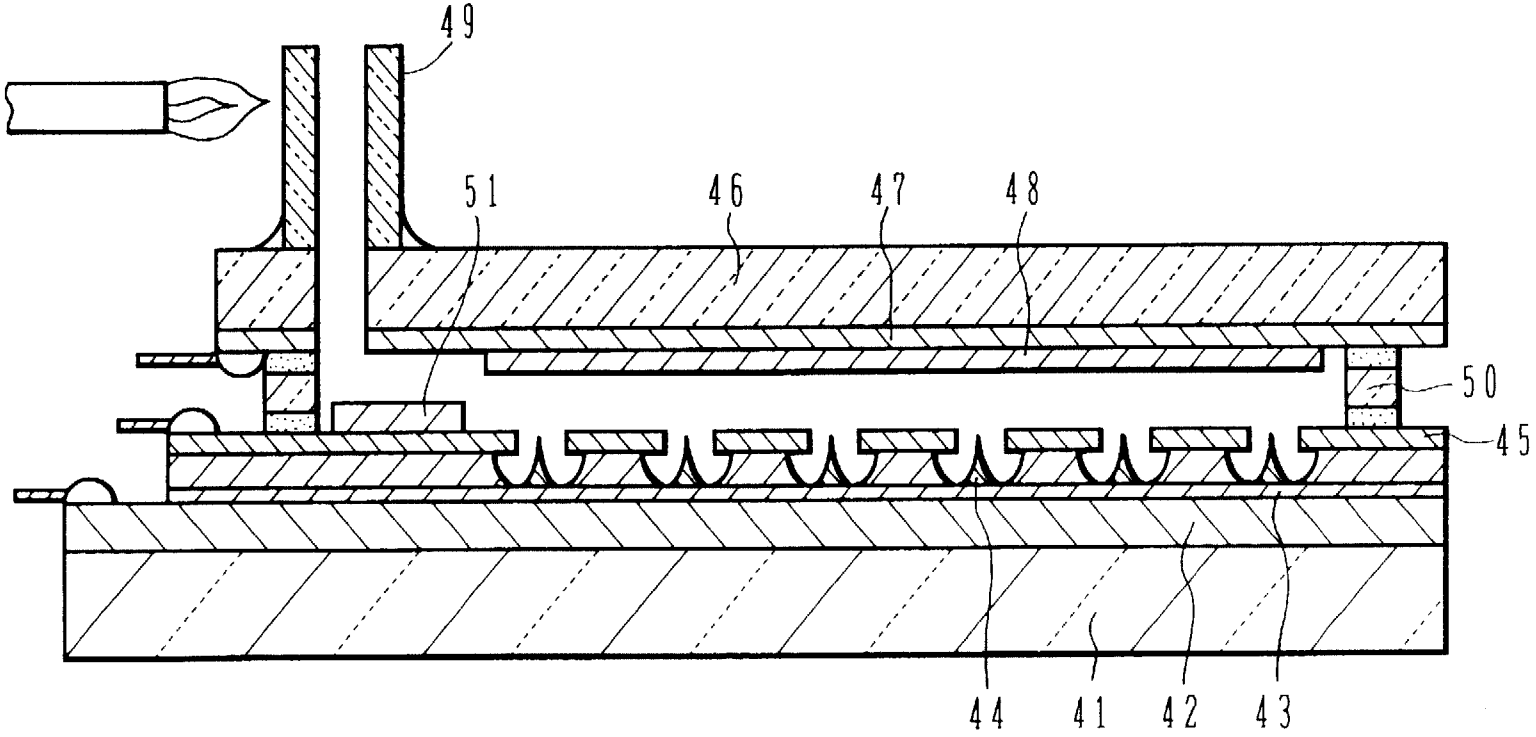
FIG. 30 is a cross sectional view of an application example of an electric field emission type device to a display unit.

FIG. 30 shows a flat panel display which is one of application examples of the electric field emission type device formed by the embodiment methods of this invention. An electron emission source is formed by the embodiment methods of the invention. On an insulating substrate 41, a conductive film 42 of Al or Cu and a resistor film 43 such as a polysilicon film are formed. On the resistor film 43, fine emitters 44 are formed and disposed in the openings of gate electrodes 45.

An opposing substrate is disposed facing the electron emission source, the counter substrate being formed with a transparent conductive film 47 such as ITO serving as an anode electrode and a fluorescent film 48. The gate electrode 45, conductive film 42, resistor film 43, fluorescent film 48, and transparent conductive film 47 may be formed discretely in correspondence with each pixel, instead of forming them integrally. A getter material 51 such as Ti, Al, and Mg is mounted on the side of the electron emission source in order to prevent emitted gas from attaching the emitter surface.

The opposing substrate is attached to the electron emission source by a spacer 50 coated with adhesive, for the separation of the transparent conductive film 47 serving as the anode electrode from the emitter 44 by about 0.1 to 5 mm. For example, glass of a low melting point is used as the adhesive. Instead of the glass spacer, adhesive such as epoxy resin containing dispersed glass beads may be used as the spacer.

The opposing substrate has an exhaust pipe 49 connected thereto. After the opposing substrate is adhered, the inside of the panel display is evacuated from this exhaust pipe 49 to about $10^{-3}$ to $10^{-8}$ Torr. The opening of the exhaust pipe is sealed by using a burner or other means. Thereafter, lead wires are connected to the anodes, emitters, and gates to complete the flat panel display.

Figure 31:
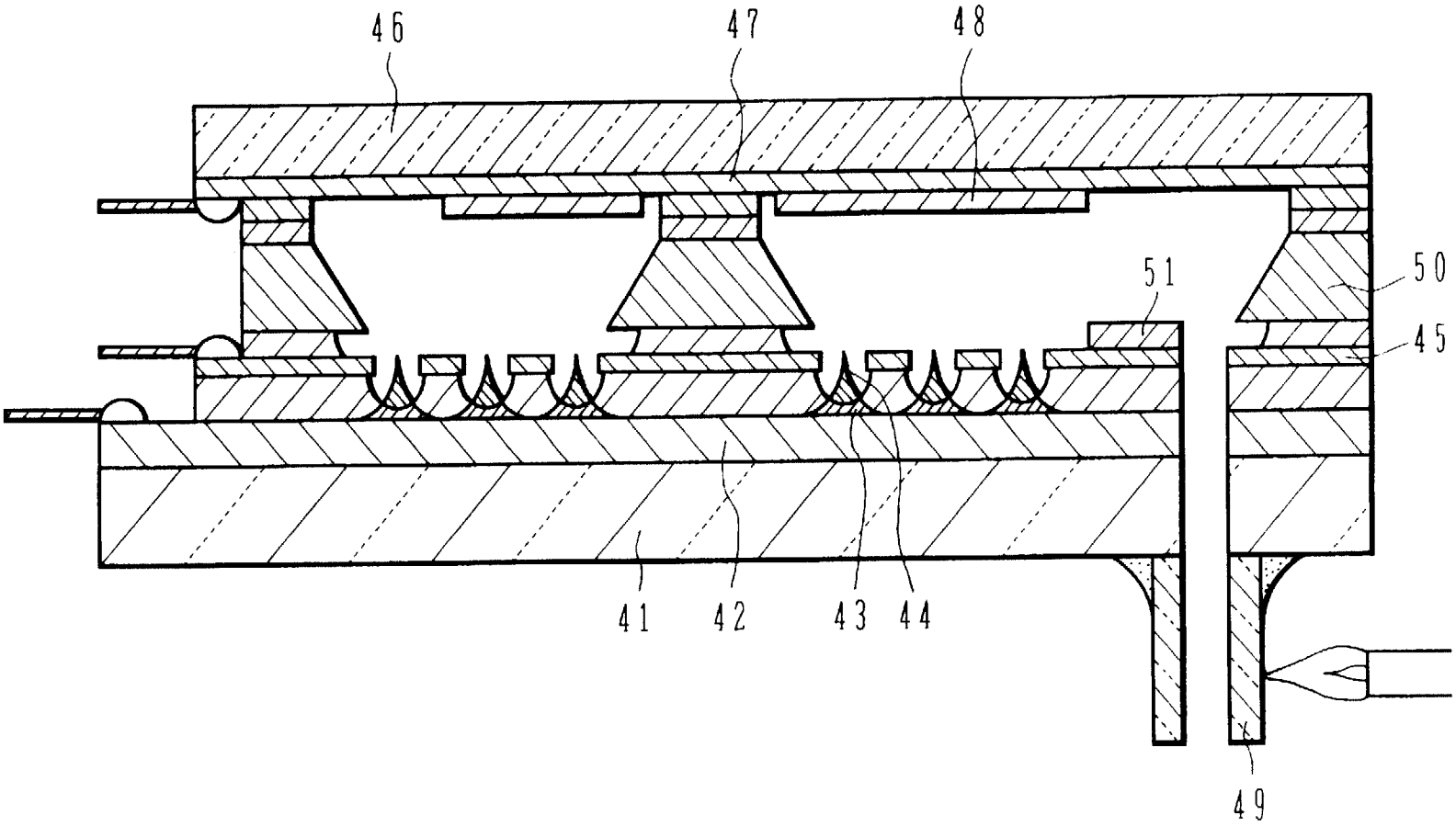
FIG. 31 is a cross sectional view of another application example of an electric field emission type device to a display unit.

FIG. 31 shows an example of the structure of another flat panel display. Like elements to those shown in FIG. 30 are represented by using identical reference numerals, and the detailed description thereof is omitted. In this embodiment, an exhaust pipe 49 is connected on the side of the electron emission source. A spacer 50 is made of a silicon substrate worked to have a proper dimension.

Figure 32:
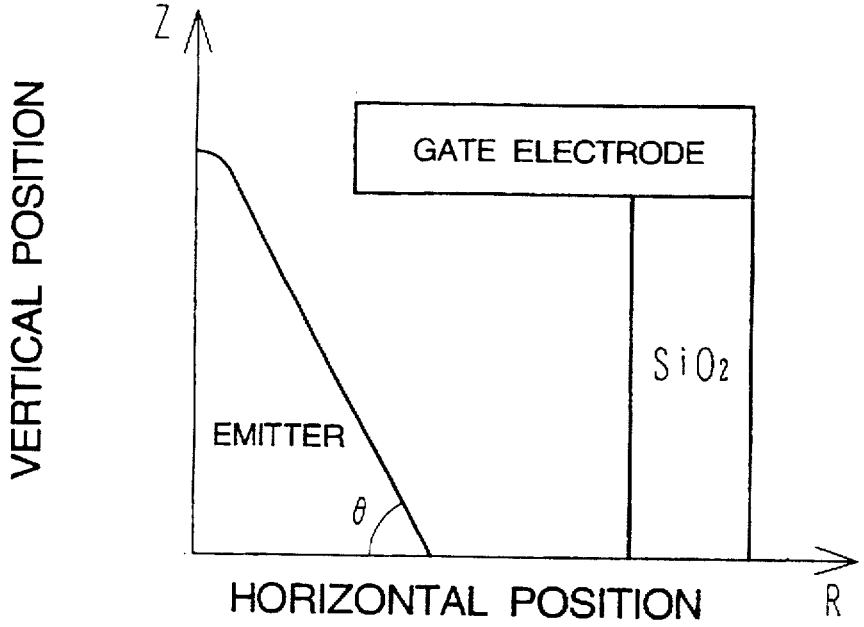
FIG. 32 is a schematic cross sectional diagram illustrating the conditions of simulation used for confirming the effectiveness of this invention.

Next, data indicating the effectiveness of this invention will be explained. Data regarding the relationship between the electric field emission characteristics and the emitter shape and the like will first be described. FIG. 32 shows parameters used for simulation. The emitter is a point type emitter with rotation symmetry about the Z axis. θ is an emitter taper angle, $r_e$ is a radius of curvature of the emitter tip, $r_a$ is a distance between the emitter and the gate electrode, $t_a$ is a thickness of the gate electrode, and $t_{ox}$ is a thickness of the oxide film supporting the gate electrode. Each parameter, when not used as a variable, was set as θ=60°, $r_e$=10 nm, $r_a$=0.4 μm, $t_a$=0.4 μm, and $t_{ox}$=1 μm. The height of the emitter was fixed to 1 μm.

Figure 33:
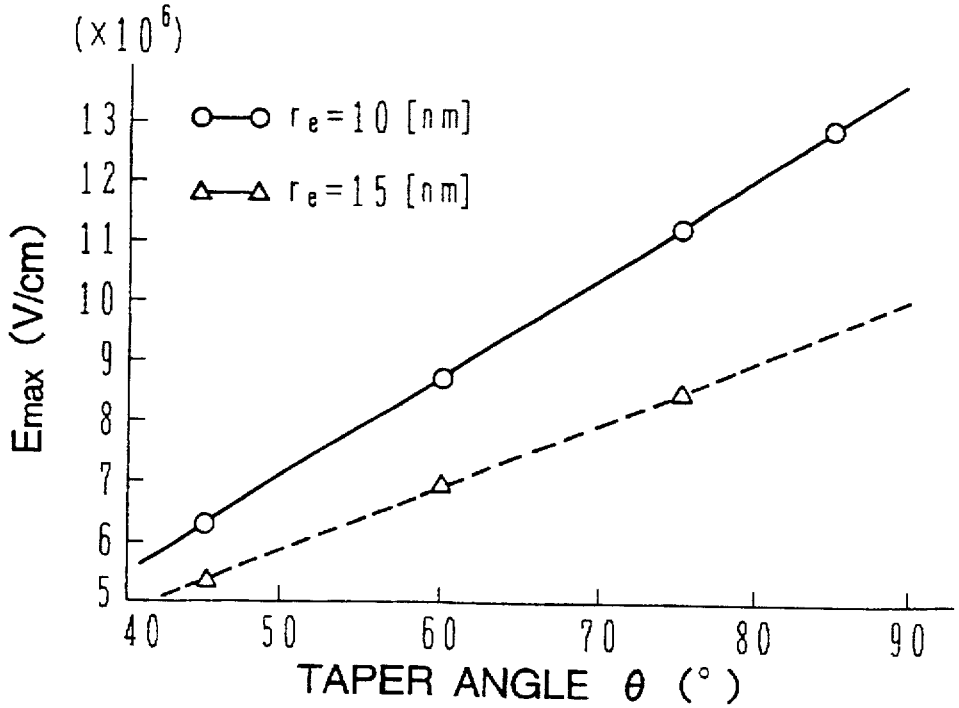
FIG. 33 is a graph showing the relationship between a maximum electric field intensity Emax and a slope angle θ, obtained by simulation.

FIG. 33 shows the relationship between a taper angle θ and a maximum electric field intensity Emax obtained at the emitter tip, using the radius $r_e$ of curvature of the emitter tip as a parameter. The larger the taper angle θ, i.e., the smaller the emitter apex angle, the larger the maximum electric field intensity Emax. The maximum electric field intensity Emax becomes larger by about 30% at $r_e$=10 nm than $r_e$=15 nm.

Figure 34:
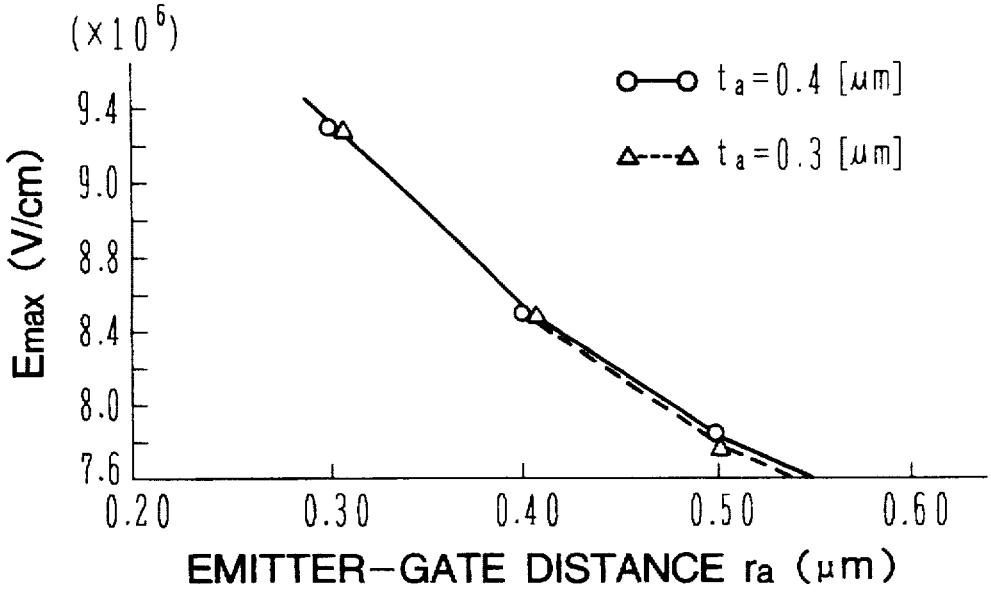
FIG. 34 is a graph showing the relationship between a maximum electric field intensity and an emitter-gate distance $r_a$, obtained by simulation.

FIG. 34 shows the relationship between an emitter-gate electrode distance and a maximum electric field intensity Emax, using the gate electrode thickness $t_a$ as a parameter. The shorter the emitter-gate electrode distance $r_a$, the larger the maximum electric field intensity Emax. There is almost no significant difference between the gate electrode thickness $t_a$=0.3 μm and $t_a$=0.4 μm.

It is understood from the simulation data shown in FIGS. 33 and 34 that preferably an emitter has a small apex angle and a sharp tip like a whisker.

Figure 35:
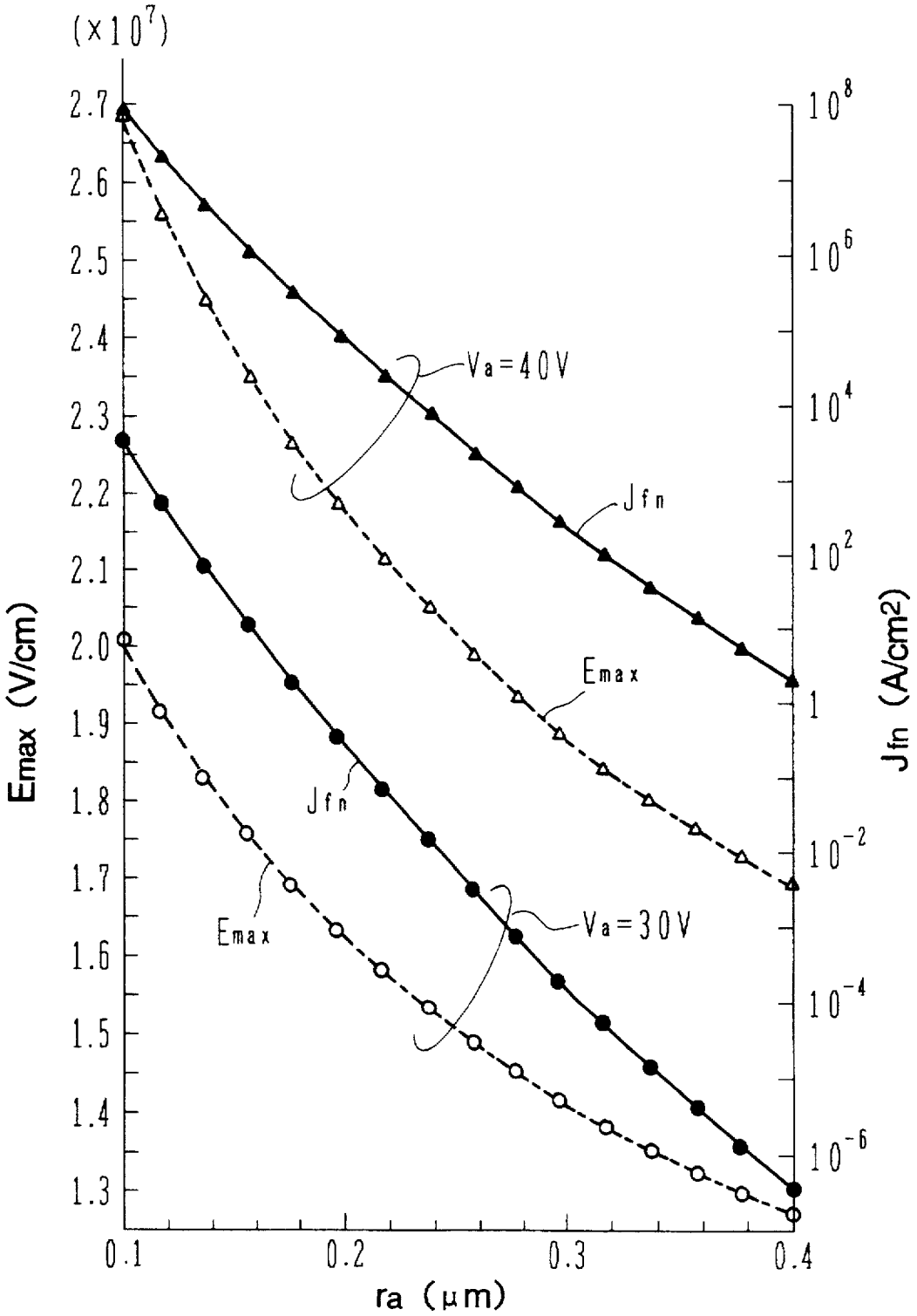
FIG. 35 is a graph showing the relationship between a maximum electric field intensity and an emitter-gate distance $r_a$, obtained by simulation.
Figure 36A:
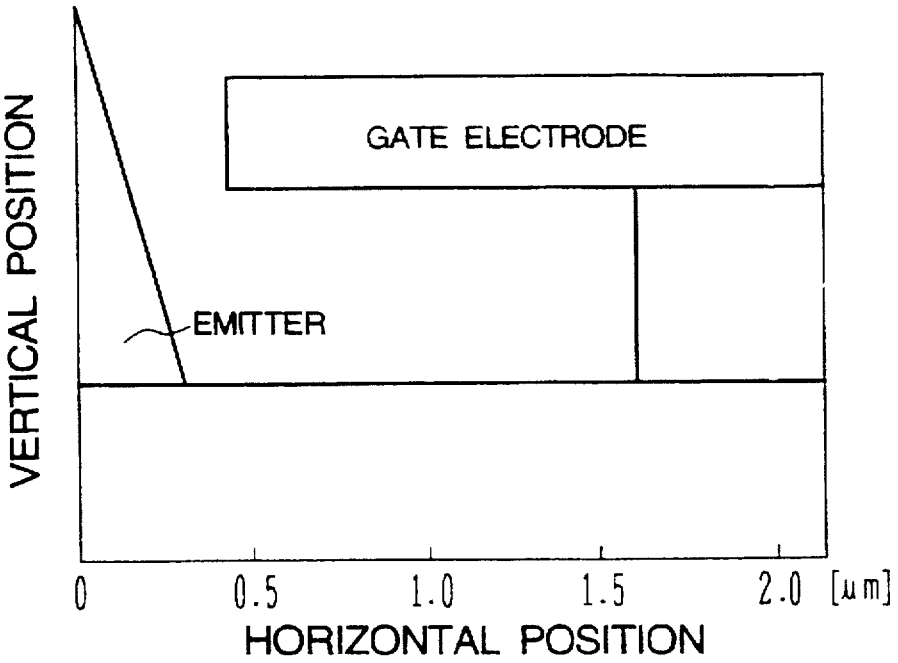
FIGS. 36A and 36B are a schematic cross sectional diagram showing a positional relationship between an emitter and a gate, and a graph showing the electric field distribution in the configuration of FIG. 36A, obtained by simulation.
Figure 36B:
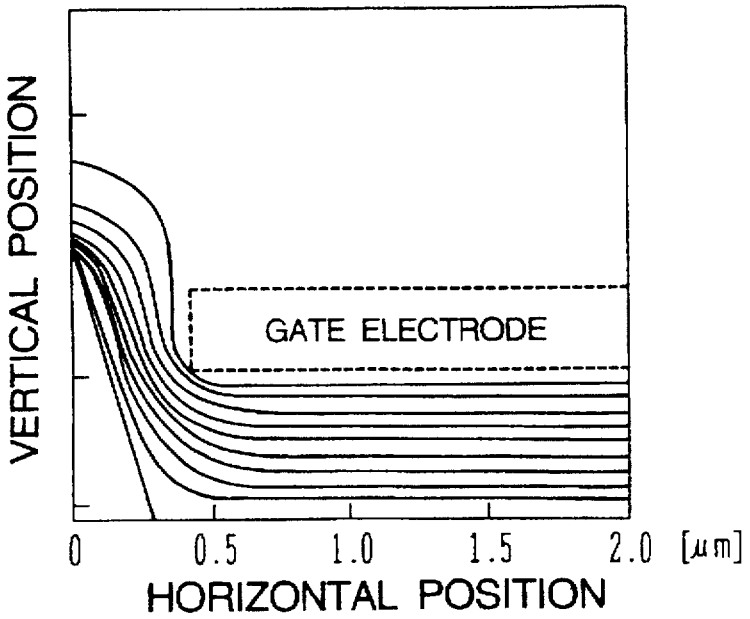
Figure 37A:
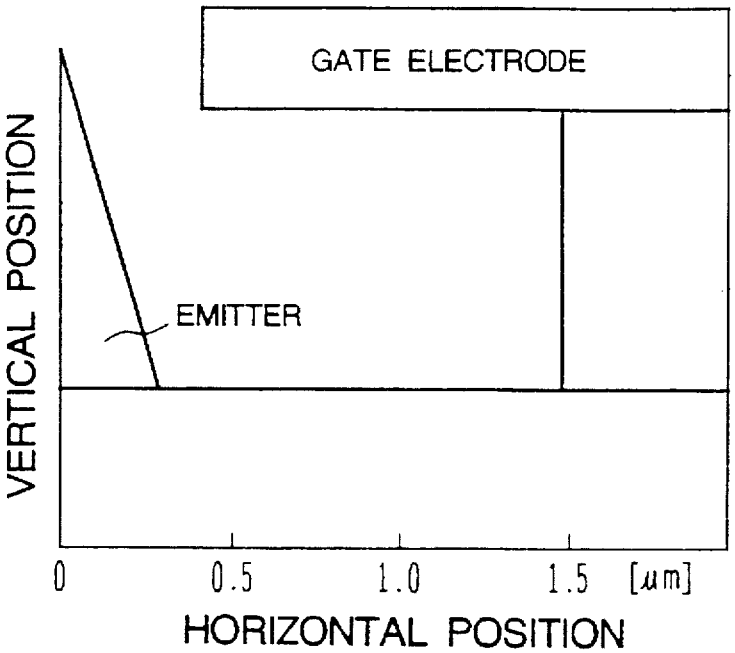
FIGS. 37A and 37B are a schematic cross sectional diagram showing another positional relationship between an emitter and a gate, and a graph showing the electric field distribution in the configuration of FIG. 37A, obtained by simulation.
Figure 37B:
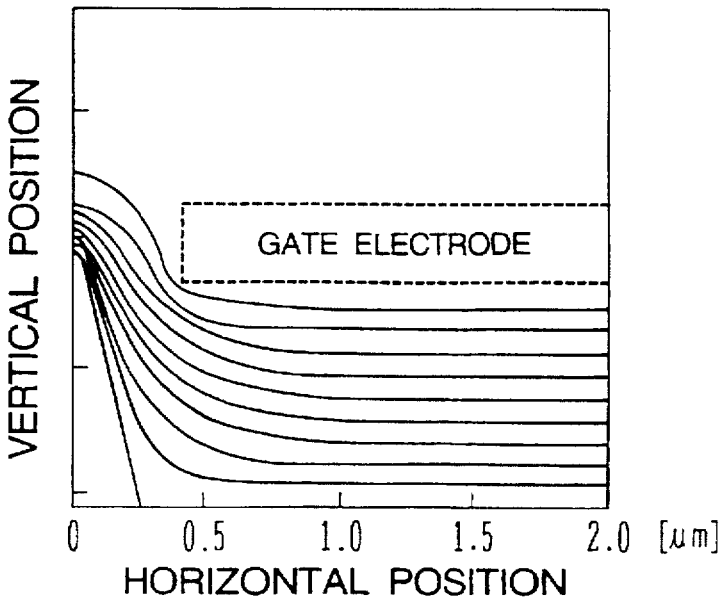

FIG. 35 shows the relationship among a shorter emitter-gate electrode distance $r_a$, a maximum electric field intensity Emax, and an emitter current Jfn. The emitter-gate voltage was set to Va=30 V and Va=40 V, and it was assumed that the work function of the emitter material was 4.5 eV. In order to obtain current of Jfn=1.3 A/cm$^2$ at $r_a$=0.4 μm, it is necessary to set the emitter-gate voltage to Va=40 V. However, at $r_a$=0.18 μm, the same amount of current can be obtained even at Va=30 V. It is noted that at the same emitter-gate voltage, the smaller the distance $r_a$, the larger the emission current.

FIGS. 36A and 36B and FIGS. 37A and 37B illustrate the positional relationship between the gate electrode and the emitter in the Z direction, and the electric field distribution around the emitter tip. The distance $Z_{ge}$ between the center of the gate in the Z direction and the apex position of the emitter tip is set to $Z_{ge}$=−0.3 μm in FIGS. 36A and 36B, and $Z_{ge}$=0 in FIGS. 37A and 37B.

Figure 38A:
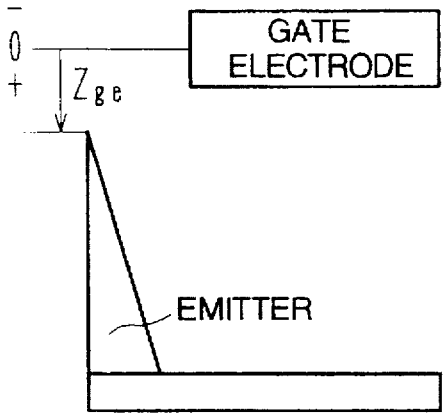
FIGS. 38A and 38B are a schematic cross sectional diagram showing another positional relationship between an emitter and a gate, and a graph showing the relationship between the maximum electric field intensity and the height of gate from the tip of the emitter, Zge, obtained by simulation.
Figure 38B:
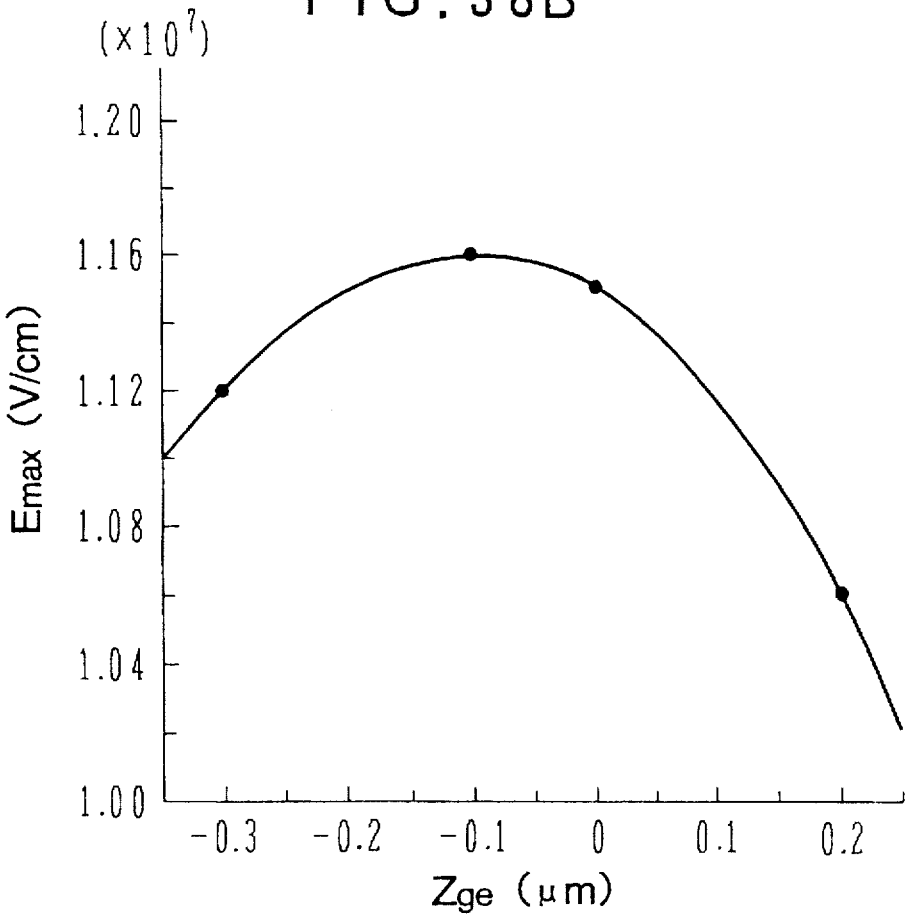

FIG. 38 shows a change in the maximum electric field intensity Emax near at the apex position of the emitter tip when the positional relationship between the emitter and the gate electrode, i.e., the Z direction distance $Z_{ge}$, is changed from −0.35 μm to 0.25 μm. At $Z_{ge}$=−0.1 μm, Emax takes a local maximum of $1.16\times10^7$ V/cm.

FIGS. 39 to 42 show simulation data which demonstrates that an emitter having a sharp tip can be stably formed by the embodiment methods of the invention. The simulation results of sacrificial film deposition compare the prior art and the embodiment methods of this invention, the former directly depositing a sacrificial film on a substrate with a recess having a vertical side wall, and the latter depositing a second sacrificial film on a substrate with a recess having a slanted side wall of the side spacer formed by a first sacrificial film. The left side of each drawing shows the embodiment method with a recess having a slanted side spacer whose slope is approximated by a straight line.

The simulation conditions are indicated in each drawing. The recess diameter is a diameter at the upper end of the recess. The migration length is a distance that a molecule or a cluster (group of molecules) moves on the surface of the substrate. If a film has better step coverage, the migration length is elongated. In each drawing, the recess diameter, recess depth, and migration length are the same both for the prior art and the embodiment method. Film deposition is shown by a broken line at a thickness pitch of 0.05 μm in the direction perpendicular to the substrate. A solid line indicates the film thickness at which a sharp apex is first obtained.

Figure 39:
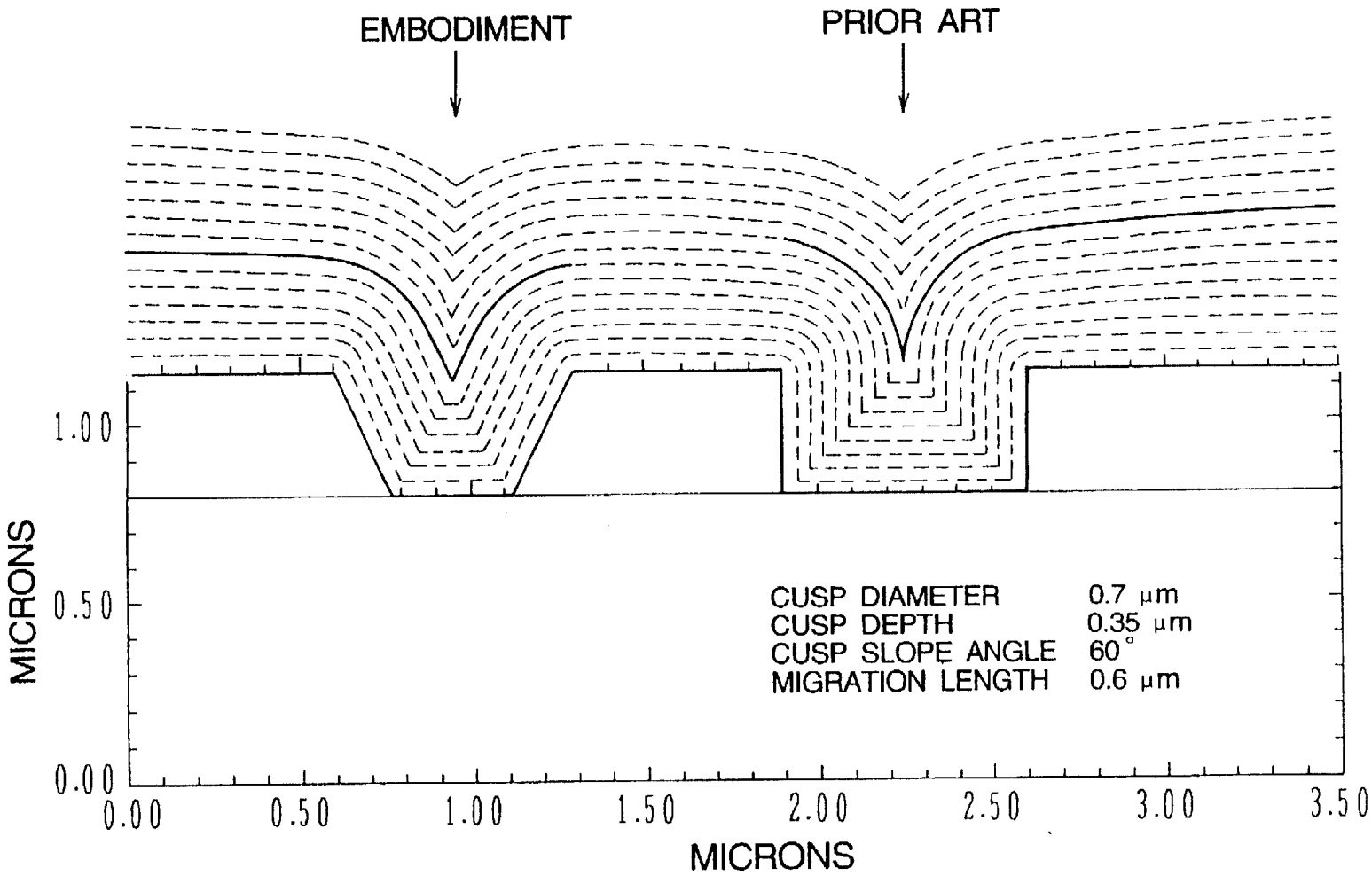
FIG. 39 is a cross sectional diagram showing surfaces of a deposited film according to the embodiment of the invention and to the prior art, obtained by simulation.

Under the conditions shown in FIG. 39, a good emitter mold is obtained at a film thickness of 0.35 μm by the embodiment method, while it is at 0.45 μm by the prior art.

Figure 40:
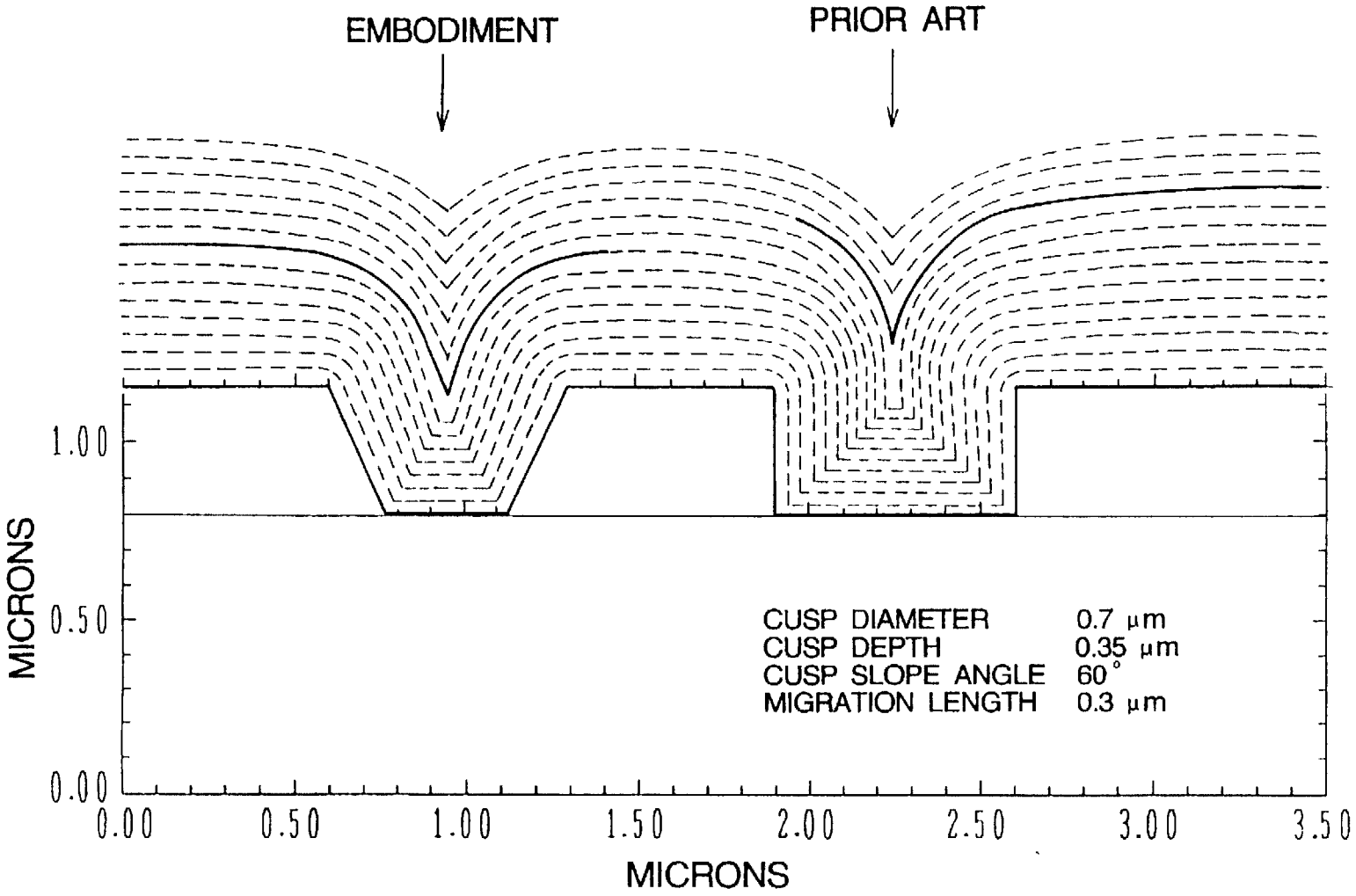
FIG. 40 is a cross sectional diagram showing surfaces of a deposited film according to the embodiment of the invention and to the prior art, obtained by simulation.

Under the conditions shown in FIG. 40, a good emitter mold is obtained at a film thickness of 0.4 μm by the embodiment method, while it is at 0.6 μm by the prior art.

Figure 41:
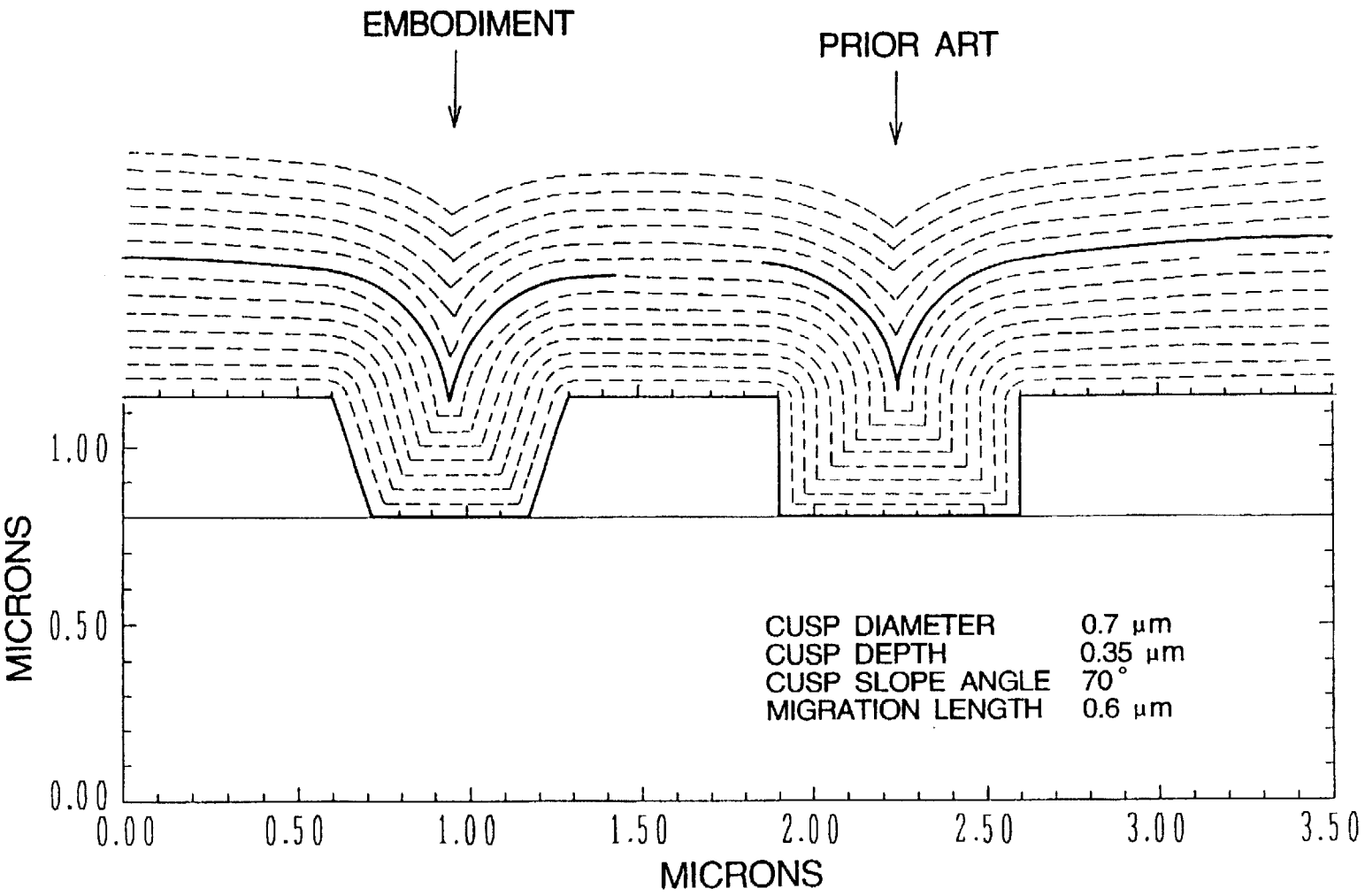
FIG. 41 is a cross sectional diagram showing surfaces of a deposited film according to the embodiment of the invention and to the prior art, obtained by simulation.

Under the conditions shown in FIG. 41, those thicknesses are 0.4 μm and 0.45 μm. This may mean that a taper angle of 70° may not enough and is preferably lowered further.

Figure 42:
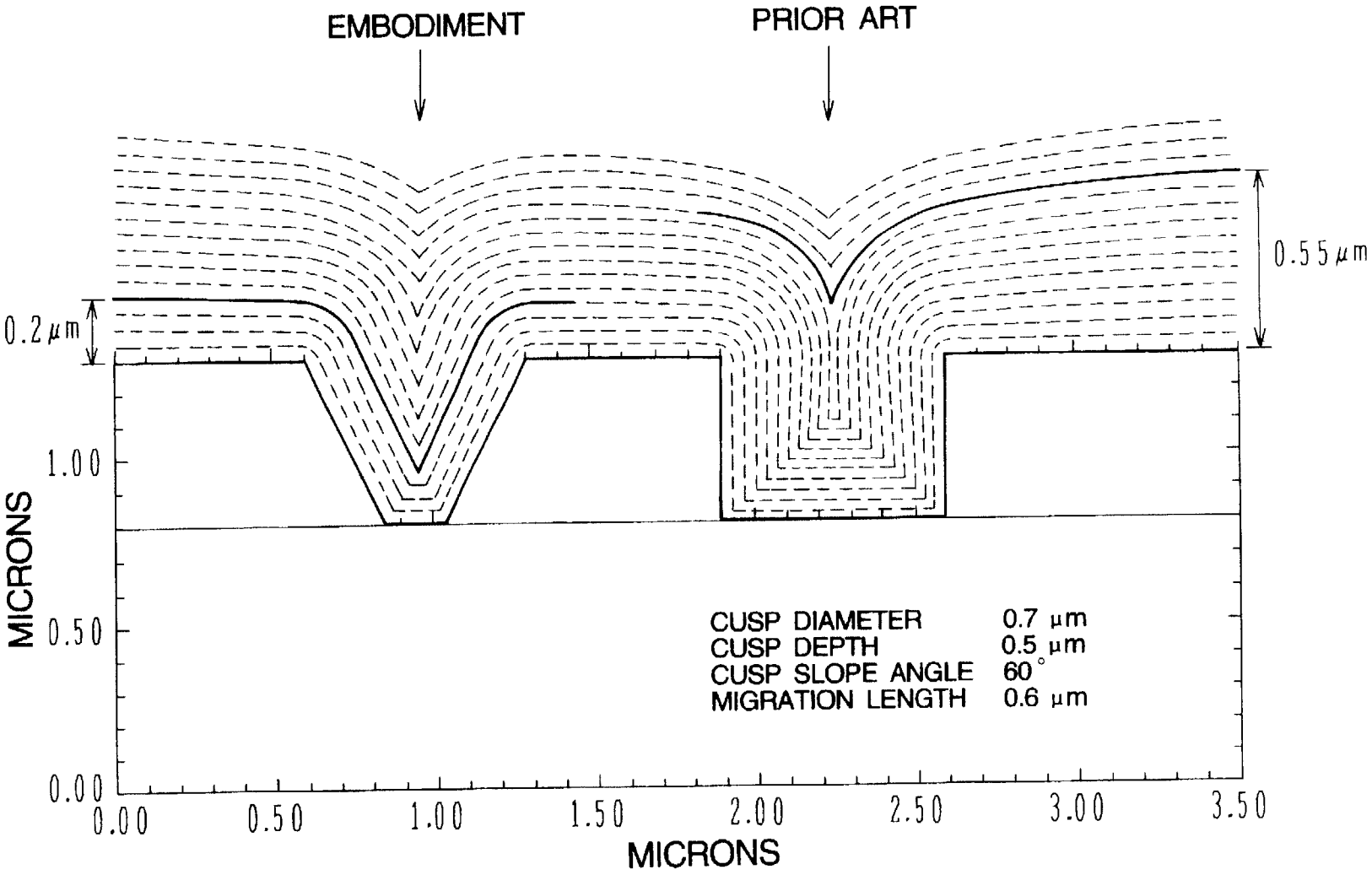
FIG. 42 is a cross sectional diagram showing surfaces of a deposited film according to the embodiment of the invention and to the prior art, obtained by simulation.
Figure 43A:
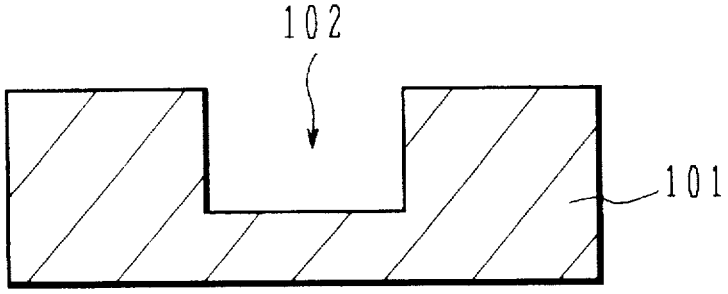
FIG.43A (PRIOR ART)
FIGS. 43A to 43C are cross sectional views for illustrating a conventional method of forming an emitter.
Figure 43B:
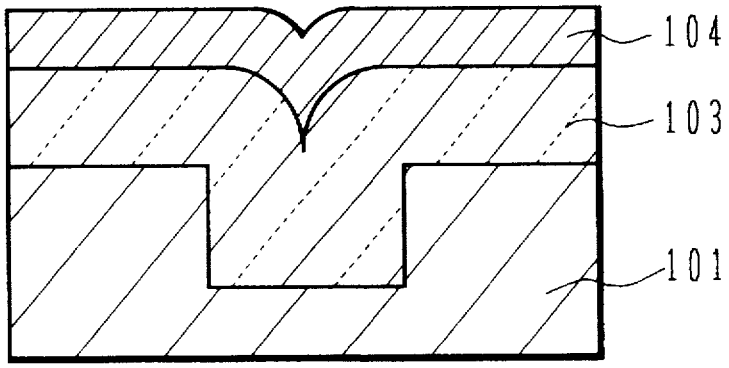
FIG.43B (PRIOR ART)
Figure 43C:
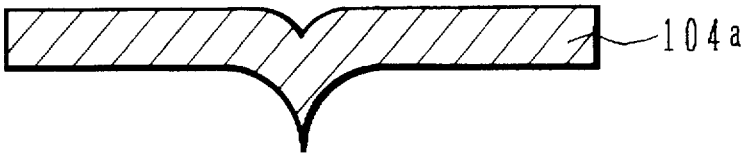
FIG.43C (PRIOR ART)
Figure 44A:
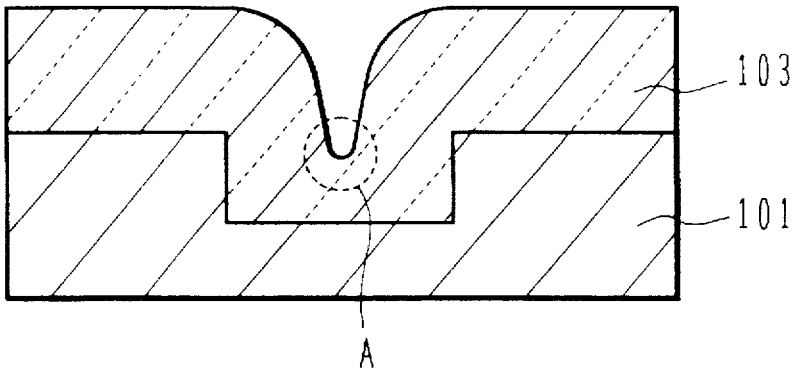
FIG.44A (PRIOR ART)
FIGS. 44A to 44C are cross sectional views for illustrating conventional methods of depositing a sacrificial film.
Figure 44B:
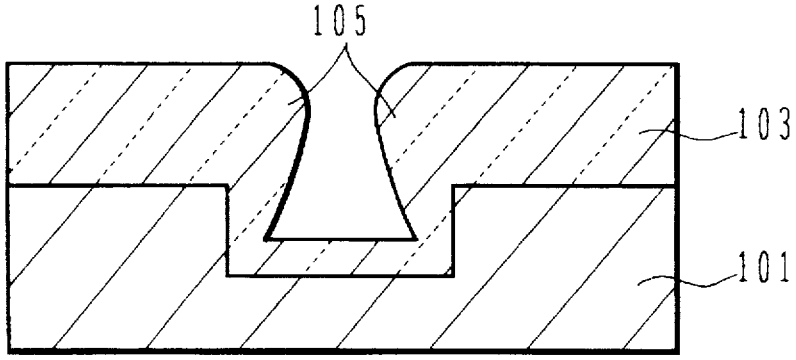
FIG.44B (PRIOR ART)
Figure 44C:
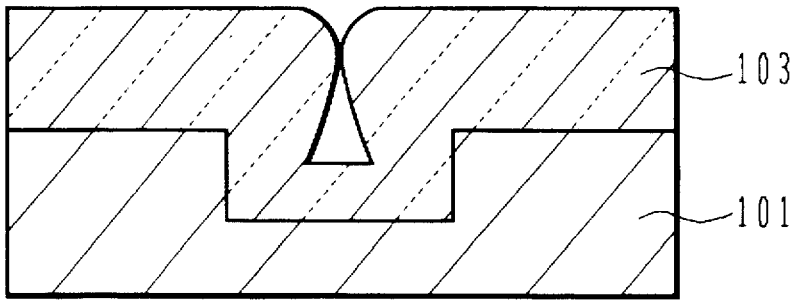
FIG.44C (PRIOR ART)
Figure 45A:
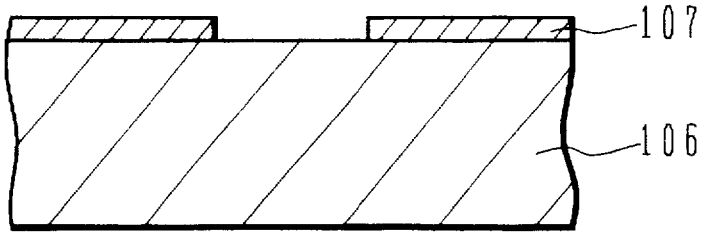
FIG.45A (PRIOR ART)
FIGS. 45A to 45D are cross sectional views for illustrating another conventional method of forming an emitter.
Figure 45B:
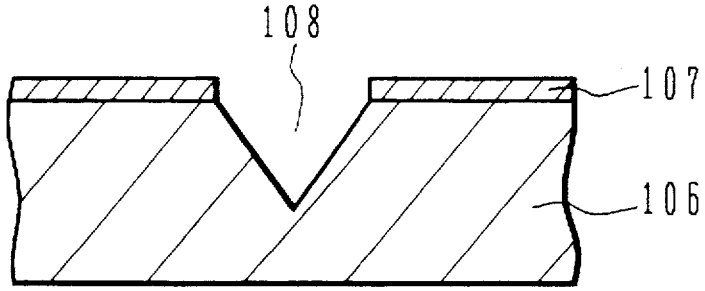
FIG.45B (PRIOR ART)
Figure 45C:
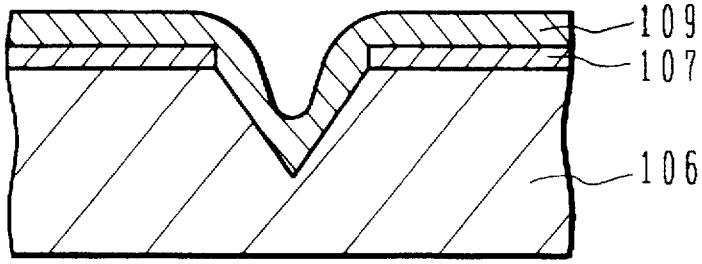
FIG.45C (PRIOR ART)
Figure 45D:
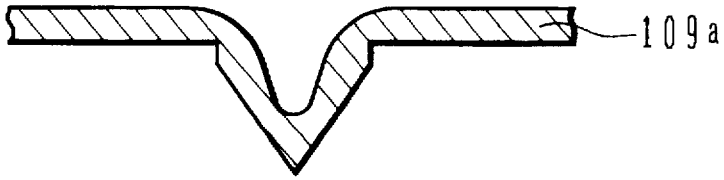
FIG.45D (PRIOR ART)
Figure 46A:
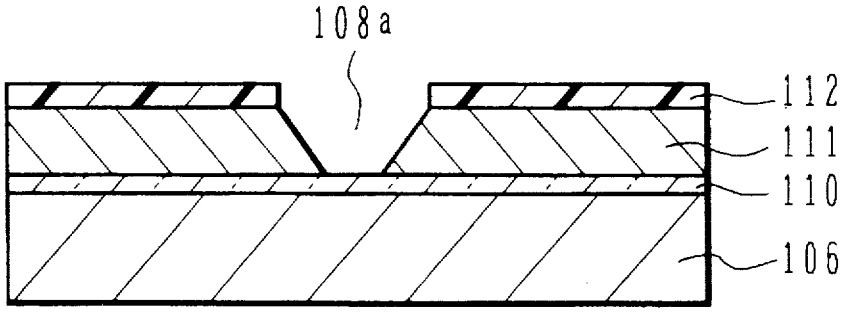
FIG.46A (PRIOR ART)
FIGS. 46A and 46B are cross sectional views for illustrating still another conventional method of forming an emitter.
Figure 46B:
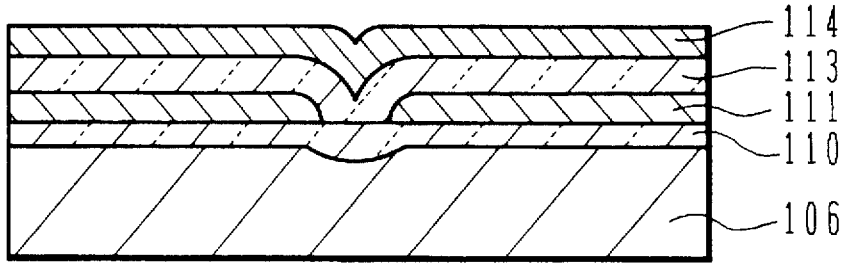
FIG.46B (PRIOR ART)

Under the conditions shown in FIG. 42, a good emitter mold is obtained at a film thickness of 0.2 μm by the embodiment method, while it is at 0.55 μm by the prior art.

From the simulation results of the embodiment methods of this invention using the side spacer shown in FIGS. 39 to 42, it can be understood that a proper emitter mold can be obtained even if a sacrificial film is thin and that the shape of an emitter mold does not change greatly with the recess depth and migration length.

The present invention has been described in connection with the preferred embodiments. The invention is not limited only to the above embodiments. It is apparent to those skilled in the art that various modifications, improvements, combinations and the like can be made without departing from the scope of the appended claims.

I claim:

1. A method of manufacturing a microelectronic device comprising the steps of:

(a) providing a hole in a substrate;

(b) forming a first sacrificial film having a side surface on a side wall of the hole with a first material;

(c) applying a second sacrificial film on the first sacrificial film to fill the hole and form a cusp;

(d) forming an electron emitting material layer on the second sacrificial film to fill the cusp to form a tip; and (e) removing the first sacrificial film and the second sacrificial film to expose the tip;

wherein the second sacrificial film comprises a non-conformal layer.

2. A method of manufacturing a microelectronic device comprising the steps of:

(a) providing a hole in a substrate;

(b) forming a first sacrificial film having a side surface on a side wall of the hole with a first material;

(c) applying a second sacrificial film on the first sacrificial film to fill the hole and form a cusp;

(d) forming an electron emitting material layer on the second sacrificial film to fill the cusp to form a tip;

(e) removing the first sacrificial film and the second sacrificial film to expose the tip;

(f) removing the substrate; and (g) forming a supportive layer on the electron emitting material layer.

3. A method of manufacturing a microelectronic device comprising the steps of:

providing a hole in a substrate;

forming a non-conformal layer having an overhang above the hole on the substrate;

partially removing the non-conformal layer to leave the first sacrificial film on the side wall of the hole and to expose a bottom of the hole, wherein the first sacrificial layer has a first arcuate portion and a second arcuate portion smaller than the first arcuate portion;

filling the hole with a second sacrificial film on the first sacrificial film to form a first cusp and a second cusp which correspond to the first arcuate portion and the second arcuate portion, respectively; and forming an electron emitting material layer on the first and second sacrificial films to form a first tip and a second tip which correspond to the first cusp and the second cusp, respectively.

4. A method of manufacturing a microelectronic device comprising the steps of:

(a) providing a substrate comprising a silicon body having a silicon oxide layer and a laminated conductive layer;

(b) providing a hole through said laminated conductive layer;

(c) forming a first sacrificial film on a side wall of the hole with a first material;

(d) filling the hole with a second sacrificial film on the first sacrificial film to form a cusp;

(e) forming an electron emitting material layer on the second artificial film to fill the cusp to form a tip; and (f) removing the first sacrificial film and the second sacrificial film to expose the tip;

wherein the laminated conductive layer comprises a polysilicon layer and a tungsten silicide layer.

5. A method of manufacturing a microelectronic device comprising the steps of:

(a) providing a substrate comprising a silicon body having a silicon oxide layer and a laminated conductive layer;

(b) providing a hole through said laminated conductive layer;

(c) forming a first sacrificial film on a side wall of the hole with a first material:

(d) filling the hole with a second sacrificial film on the first sacrificial film to form a cusp;

(e) forming an electron emitting material layer on the second artificial film to fill the cusp to form a tip; and (f) removing the first sacrificial film and the second sacrificial film to expose the tip;

wherein the electron emitting material layer is made of a laminated structure of a TiN layer, a W layer and an Al layer, and a glass layer is provided on the laminated structure.

6. A method of manufacturing a microelectronic device comprising the steps of:

(a) providing a substrate;

(b) providing a hole in a surface of said substrate;

(c) forming a first sacrificial film on a side wall of the hole with a first material;

(d) filling the hole with a second sacrificial film on the first sacrificial film to form a cusps;

(e) forming an electron emitting material layer on the second artificial film to fill the cusp to form a tip; and (f) removing the first sacrificial film and the second sacrificial film to expose the tip;

wherein the tip has a laminated structure of a first tip film, a resistive film and an Al film.

7. A method according to claim 6, wherein the first tip film comprises a material selected from a group consisting of W and TiN.

8. A method of manufacturing a microelectronic device comprising the steps of:

(a) providing a hole in a substrate;

(b) forming a first sacrificial film having a side surface on a side wall of the hole with a first material;

(c) applying a second sacrificial film on the first sacrificial film to fill the hole and form a cusp;

(d) forming an electron emitting material layer on the second sacrificial film to fill the cusp to form a tip; and (e) removing the first sacrificial film and the second sacrificial film to expose the tip;

wherein the step (b) comprises the steps of:

(b-1) forming a conformal layer on the substrate; and (b-2) partially removing the conformal layer to leave the first sacrificial film on the side wall of the hole and to expose a bottom of the hole.

9. A method according to claim 8, wherein at the step (b-2) the exposed bottom of the hole is slightly removed to form a depression therein.

10. A method according to claim 8, wherein the first sacrificial film and the second sacrificial film comprise a material selected from a group consisting of silicon oxide, silicon nitride, amorphous silicon, polysilicon, Ti, Mo, Al, TiN, TiW and WSi.

11. A method according to claim 8, wherein the electron emitting material layer comprises a material selected from a group consisting of W, Al, Cu, Mo, Au, Pt, Ag, Ti, Ni, Ta, Re, Cr, Zr, Hf, Y, Bi, Sr, Tl, Pb, Ca, Sn, Ge and the compounds thereof.

12. A method of manufacturing a microelectronic device comprising the steps of:

(a) providing a substrate;

(b) providing a hole in a surface of said substrate;

(c) forming a first sacrificial film on a side wall of the hole with a first material, said first sacrificial film being formed by:

forming a conformal layer on the substrate; and partially removing the conformal layer to leave the first sacrificial film on the side wall of the hole and to expose a bottom of the hole;

(d) filling the hole with a second sacrificial film on the first sacrificial film to form a cusp;

(e) forming an electron emitting material layer on the second artificial film to fill the cusp to form a tip; and (f) removing the first sacrificial film and the second sacrificial film to expose the tip.

13. A method according to claim 12, wherein the substrate comprises a laminate including a conductive layer serving as an anode for the tip and an insulating layer disposed thereon.

14. A method according to claim 12, wherein the substrate comprises a silicon body having a silicon oxide layer and a laminated conductive layer, and the hole is provided through the laminated conductive layer.

15. A method according to claim 12, wherein the first sacrificial film and the second sacrificial film comprise a material selected from a group consisting of silicon oxide, silicon nitride, amorphous silicon, polysilicon, Ti, Mo, Al, TiN, TiW and WSi.

16. A method according to claim 12, wherein the electron emitting material layer comprises a material selected from a group consisting of W, Al, Cu, Mo, Au, Pt, Ag, Ti, Ni, Ta, Re, Cr, Zr, Hf, Y, Bi, Sr, Tl, Pb, Ca, Sn, Ge and the compounds thereof.

17. A method of manufacturing a microelectronic device comprising the steps of:

(a) providing a substrate having a first layer formed thereon;

(b) providing a hole through the first layer;

(c) forming a first sacrificial film on a side wall of the hole with a first material to form a side spacer;

(d) deepening the hole through the side spacer;

(e) filling the deepened hole with a second sacrificial film on the first sacrificial film to form a cusp;

(f) forming an electron emitting material on the second sacrificial film to fill the cusp to form a tip; and (g) removing the second sacrificial film in the substrate to expose the tip.

18. A method according to claim 17, wherein the substrate comprises a substrate body having an anode layer and an insulating layer thereon.

19. A method according to claim 17, wherein the substrate comprises a substrate body having an anode layer, an insulating layer and a gate layer thereon and the deepened hole reaches to a surface of the anode layer.

20. A method according to claim 17, wherein the first sacrificial film and the second sacrificial film comprise a material selected from a group consisting of silicon oxide, silicon nitride, amorphous silicon, polysilicon, Ti, Mo, Al, TiN, TiW and WSi.

21. A method according to claim 17, wherein the electron emitting material layer comprises a material selected from a group consisting of W, Al, Cu, Mo, Au, Pt, Ag, Ti, Ni, Ta, Re, Cr, Zr, Hf, Y, Bi, Sr, Tl, Pb, Ca, Sn, Ge and the compounds thereof.

* * * * *